US007965027B2

(12) United States Patent
Onishi

(10) Patent No.: US 7,965,027 B2
(45) Date of Patent: Jun. 21, 2011

(54) LIGHT-EMITTING SUBSTRATE, IMAGE DISPLAY APPARATUS, AND INFORMATION DISPLAY AND REPRODUCTION APPARATUS USING IMAGE DISPLAY APPARATUS

(75) Inventor: Tomoya Onishi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/436,371

(22) Filed: May 6, 2009

(65) Prior Publication Data

US 2009/0236966 A1 Sep. 24, 2009

Related U.S. Application Data

(62) Division of application No. 11/201,139, filed on Aug. 11, 2005, now Pat. No. 7,554,256.

(30) Foreign Application Priority Data

Aug. 19, 2004 (JP) ..... 2004-239528

(51) Int. Cl.
*H01J 1/30* (2006.01)

(52) U.S. Cl. ..... 313/495; 313/496; 313/497

(58) Field of Classification Search ..... 313/495–497
See application file for complete search history.

(56) References Cited

U.S. PATENT DOCUMENTS

| | | | | |
|---|---|---|---|---|
| 5,532,548 | A | 7/1996 | Spindt et al. | 313/422 |
| 5,770,918 | A | 6/1998 | Kawate et al. | 313/495 |
| 5,789,857 | A | 8/1998 | Yamaura et al. | 313/495 |
| 5,903,108 | A | 5/1999 | Mougin et al. | 315/169.1 |
| 5,945,969 | A | 8/1999 | Westphal | 345/75 |
| 6,046,539 | A | 4/2000 | Haven et al. | 313/461 |
| 6,053,791 | A | 4/2000 | Fujii et al. | 445/6 |
| 6,114,804 | A | 9/2000 | Kawase et al. | 313/495 |
| 6,144,153 | A | 11/2000 | Nakatani | 313/495 |
| 6,267,636 | B1 | 7/2001 | Onishi et al. | 445/6 |
| 6,278,066 | B1 | 8/2001 | Fahlen et al. | 174/250 |
| 6,379,211 | B2 | 4/2002 | Onishi et al. | 445/73 |
| 6,441,544 | B1 | 8/2002 | Ando et al. | 313/310 |
| 6,486,610 | B2 * | 11/2002 | Kojima et al. | 315/169.3 |
| 6,509,691 | B2 | 1/2003 | Yamazaki et al. | 315/169.3 |

(Continued)

FOREIGN PATENT DOCUMENTS

EP 0 806 788 A1 11/1997

(Continued)

OTHER PUBLICATIONS

M. Hartwell et al.; "Strong Electron Emission From Patterned Tin-Indium Oxide Thin Films"; International Electron Devices Meeting; 1975, pp. 519-521.

(Continued)

*Primary Examiner* — Nimeshkumar D Patel
*Assistant Examiner* — Christopher M Raabe
(74) *Attorney, Agent, or Firm* — Fitzpatrick, Cella, Harper & Scinto

(57) ABSTRACT

To suppress discharge around an anode electrode. Provided is a light-emitting substrate, including a light-emitting member for emitting light by irradiation with an electron, a first electroconductive film stacked on the light-emitting member, a second electroconductive film which is distant from an outer periphery of the first electroconductive film and surrounds the outer periphery of the first electroconductive film, and a dielectric film for covering an end portion of the second electroconductive film which is opposed to the outer periphery of the first electroconductive film.

9 Claims, 16 Drawing Sheets

U.S. PATENT DOCUMENTS

| | | | | |
|---|---|---|---|---|
| 6,534,911 | B1 | 3/2003 | Ando | 313/496 |
| 6,653,777 | B1 | 11/2003 | Onishi | 313/495 |
| 6,759,802 | B2 | 7/2004 | Ando | 3/495 |
| 6,787,983 | B2 | 9/2004 | Yamanobe et al. | 313/495 |
| 6,853,148 | B2 | 2/2005 | Yamazaki et al. | 315/169.3 |
| 6,856,097 | B2 | 2/2005 | Onishi | 315/169.1 |
| 6,884,138 | B1 | 4/2005 | Ando et al. | 445/24 |
| 7,021,981 | B2 | 4/2006 | Onishi et al. | 445/6 |
| 2002/0005692 | A1 | 1/2002 | Ando | 313/495 |
| 2002/0047574 | A1 | 4/2002 | Kojima et al. | 315/169.3 |
| 2002/0047661 | A1 | 4/2002 | Yamazaki et al. | 315/366 |
| 2003/0168991 | A1 | 9/2003 | Onishi | 315/169.3 |

FOREIGN PATENT DOCUMENTS

| | | |
|---|---|---|
| EP | 0 865 069 | 9/1998 |
| EP | 0 866490 | 9/1998 |
| EP | 1 117 124 A2 | 7/2001 |
| JP | 1-241742 | 9/1989 |
| JP | 4-94038 | 3/1992 |
| JP | 4-98744 | 3/1992 |
| JP | 4-163833 | 6/1992 |
| JP | 4-284340 | 10/1992 |
| JP | 10-097835 | 4/1998 |
| JP | 510282 | 8/2000 |
| JP | 2001-250494 | 9/2001 |
| JP | 2002-100313 | 4/2002 |
| JP | 2002-150979 | 5/2002 |
| JP | 2002-175764 | 6/2002 |
| JP | 2003-229074 | 8/2003 |
| JP | 2003-331760 | 11/2003 |
| KR | 2001-0082613 | 8/2001 |
| WO | 98/28774 | 7/1998 |
| WO | WO 98/28774 | 7/1998 |
| WO | 99/03126 | 1/1999 |

OTHER PUBLICATIONS

G. Dittmer; "Electrical Conduction and Electron Emission of Discontinuous Thin Films"; Thin Solid Films; 1972, pp. 317-328.

C.A. Mead; "Operation of Tunnel-Emission Devices"; Journal of Applied Physics; vol. 32, Jan.-Dec. 1961, pp. 646-652.

W.P. Dyke et al.; "Field Emission"; Advances in Electronics and Electron Physics; vol. VIII, 1956, pp. 89-185.

C.A. Spindt et al.; "Physical Properties of Thin-Film Field Emission Cathodes with Molybdenum Cones"; Journal of Applied Physics; vol. 47, No. 12, Dec. 1976, pp. 5248-5263.

Araki et al.; "Electroforming and Electron Emission of Carbon Thin Films"; J. Vac. Soc. Japan, 26 (1983), pp. 22-29; (with English Abstracts on p. 22).

M.L. Elinson et al.; "The Emission of Hot Electrons and the Field Emission of Electrons from Tin Oxide"; Radio Engineering and Electronic Physics; Jul. 1965, pp. 1290-1296.

* cited by examiner

ENLARGED VIEW

LIGHT-EMITTING SUBSTRATE, IMAGE DISPLAY APPARATUS, AND INFORMATION DISPLAY AND REPRODUCTION APPARATUS USING IMAGE DISPLAY APPARATUS

This application is a division of U.S. application Ser. No. 11/201,139, filed Aug. 11, 2005.

BACKGROUND OF THE INVENTION

1. Field of the Invention

The present invention relates to an image display apparatus using an electron-emitting device such as a field emission electron-emitting device or a surface conduction electron-emitting device and a light-emitting substrate used for the image display apparatus. More particularly, the present invention relates to a light-emitting substrate having a substrate on which an electrode to which a high potential is applied and an electrode to which a low potential is applied are arranged, at an interval. The present invention also relates to an information display and a reproduction apparatus using the light-emitting substrate, such as a television.

2. Related Background Art

Up to now, there have been attempts to produce an image display apparatus such as a so-called flat panel display. In such a display, a substrate including a large number of electron-emitting devices such as field emission electron-emitting devices or surface conduction electron-emitting devices is opposed to a light-emitting substrate including a phosphor such as a fluorescent material that emits light by irradiation with electrons emitted from the electron-emitting devices.

The light-emitting substrate composing the image display apparatus generally includes the phosphor such as the fluorescent material and an anode electrode that covers the phosphor (or which is located between the phosphor and a transparent insulating substrate), which are formed above the transparent insulating substrate. The anode electrode is composed of a thin electroconductive film. In particular, the anode electrode disposed on a surface of the phosphor facing (or opposed to) a substrate having the electron-emitting devices is called a "metal back". Note that the function of the anode electrode is to accelerate electrons emitted from the electron-emitting devices and to irradiate the phosphor with the electrons passed through the anode electrode. In order to, for example, sharpen a displayed image, the light-emitting substrate further includes a light absorbing layer which is called a "black matrix", a "black stripe" or the like in some cases. When the light-emitting substrate includes the light absorbing layer, the phosphor is located in an opening provided in the light absorbing layer.

When a high-resolution and high-luminance image is to be obtained on the above-mentioned flat panel display, it is preferable that an interval between the substrate on which the electron-emitting devices are arranged and the light-emitting substrate be held to 1 mm to 10 mm and a voltage of 10 kV to 30 kV be applied between both the substrates (typically, between the anode electrode and each of the electron-emitting devices).

When a high voltage is applied at such a narrow interval, for example, it is necessary to suppress the occurrence of undesirable discharge around the anode electrode. Therefore, there have been proposed that an electroconductive film to which a potential lower than a potential applied to the anode electrode is applied is located so as to surround the anode electrode (see JP 2001-250494 A, JP 2002-100313 A, JP 2002-150979 A, JP 2003-331760 A, and JP 10-097835 A).

Of those proposals, there is a proposal to locate a resistor film between the anode electrode and the electroconductive film in order to stabilize a voltage between the anode electrode and the electroconductive film located so as to surround the anode electrode.

There have been proposed the anode electrode is composed of a plurality of electroconductive films, for example, in order to suppress the occurrence of discharge between the anode electrode and each of the electron-emitting devices (see JP 2002-175764 A and JP 2003-229074 A).

SUMMARY OF THE INVENTION

However, in the above-mentioned method, there is the case where undesirable discharge is caused between the anode electrode and the electroconductive film located around the lamination of a phosphor layer and the anode electrode or the case where the structure is complicated.

Therefore, an object of the present invention is to ensure a withstand voltage between the anode electrode and the electroconductive film located around the lamination of the phosphor layer and the anode electrode using a simpler structure.

The present invention has been made with a view to achieving the object, and provides a light-emitting substrate, comprising: a light-emitting member for emitting light by irradiation with an electron; a first electroconductive film stacked on the light-emitting member; a second electroconductive film which is distant from an outer periphery of the first electroconductive film and surrounds the outer periphery of the first electroconductive film; and a dielectric film for covering an end portion of the second electroconductive film which is opposed to the outer periphery of the first electroconductive film.

Further, the present invention has the following features: the second electroconductive film is an electroconductive film having a closed ring structure; a light absorbing layer which is located on the light-emitting substrate and has a plurality of openings, wherein the light-emitting member is located corresponding to the plurality of openings, and the light-emitting member and the light absorbing layer are covered with the first electroconductive film; an end portion of the first electroconductive film which is opposed to the second electroconductive film is covered with the dielectric film; a resistance value of the dielectric film is equal to or larger than $10^8$ Ωm; the dielectric film contains a low-melting point glass or polyamide; the first electroconductive film comprises a plurality of electroconductive films which are connected in parallel through resistors; all around of the end of the second electroconductive film which is opposed to the first electroconductive film is covered with a dielectric film; a thickness of the end of the second electroconductive film which is opposed to the outer periphery of the first electroconductive film is smaller than an average film thickness of the second electroconductive film; the second electroconductive film comprises a plurality of electroconductive films which are stacked, and the end of the second electroconductive film which is opposed to the outer periphery of the first electroconductive film is formed in a stepped shape.

In addition, the present invention provides an image display apparatus, comprising: a light-emitting substrate; and a rear plate on which an electron-emitting device is located, wherein the light-emitting substrate comprises the above described light-emitting substrate, and a potential to be applied to the second electroconductive film is lower than a potential to be applied to the first electroconductive film.

Furthermore, the image display apparatus of the present invention has the following characteristics: when a length of the dielectric film covering the second electroconductive film from the end of the second electroconductive film which is opposed to the outer periphery of the first electroconductive film in a direction distant from the first electroconductive film is given by L [μm] and an average interval between the light-emitting substrate and the rear plate is given by d [μm], $$L \geqq 0.025 \times d + 15$$

is satisfied; a spacer between the light-emitting substrate and the rear plate, wherein the spacer is located across the first electroconductive film and the second electroconductive film; the dielectric film is located outside a region between the spacer and the second electroconductive film; an electron capture structure for capturing an electron, which is located between the second electroconductive film and the first electroconductive film.

In addition, the present invention provides an image display apparatus, comprising: a face plate including a light-emitting member for emitting light by irradiation with an electron, a first electroconductive film which is stacked on the light-emitting member and has substantially a quadrangular outer periphery, and a second electroconductive film which is opposed to four sides of the quadrangular outer periphery and located at a distance from the quadrangular outer periphery of the first electroconductive film; a rear plate on which an electron-emitting device is located; a power source for applying, to the second electroconductive film, a potential lower than a potential applied to the first electroconductive film; and a dielectric film for covering an end of the second electroconductive film which is opposed to each of the four sides of the quadrangular outer periphery of the first electroconductive film.

Further, the present invention provides an image display apparatus, comprising: a face plate including a light-emitting member for emitting light by irradiation with an electron, a first electroconductive film stacked on the light-emitting member, and a second electroconductive film which is distant from an outer periphery of the first electroconductive film; a rear plate on which an electron-emitting device is located; a power source for applying, to the second electroconductive film, a potential lower than a potential applied to the first electroconductive film; and a dielectric film for covering an end of the second electroconductive film which is opposed to the outer periphery of the first electroconductive film, wherein the outer periphery of the first electroconductive film is surrounded by an equipotential line which is produced based on a potential applied from the power source and passes through the second electroconductive film on the face plate.

Further the present invention provides an image display apparatus according to claim 11, wherein a difference between the potential applied to the first electroconductive film and a potential applied to the electron-emitting device is 5 kV to 30 kV and a difference between the potential applied to the second electroconductive film and the potential applied to the electron-emitting device is equal to or smaller than 1 kV.

Furthermore, the image display apparatus of the present invention has the following characteristics: a difference between the potential applied to the first electroconductive film and a potential applied to the electron-emitting device is 5 kV to 30 kV and a difference between the potential applied to the second electroconductive film and the potential applied to the electron-emitting device is equal to or smaller than 1 kV; a difference between the potential applied to the first electroconductive film and a potential applied to the electron-emitting device is 5 kV to 30 kV and a difference between the potential applied to the second electroconductive film and the potential applied to the electron-emitting device is equal to or smaller than 1 kV; a wiring connected with the first electroconductive film; and a power source connected with the wiring, wherein the wiring is led to an outside of the image display apparatus without crossing the second electroconductive film;

Furthermore, the present invention provides an information display and reproduction apparatus, comprising: a receiver for outputting at least one of video information, character information, and voice information which are included in a received broadcast signal; and an image display apparatus connected with the receiver, wherein the image display apparatus comprises the above described image display apparatus.

DETAILED DESCRIPTION OF THE PREFERRED EMBODIMENTS

Hereinafter, embodiments of the present invention will be specifically described below with reference to FIGS. 1B, 1C, 6, 7, and 10. Note that members indicated by common references in the respective drawings are identical to one another.

Figure 1A:
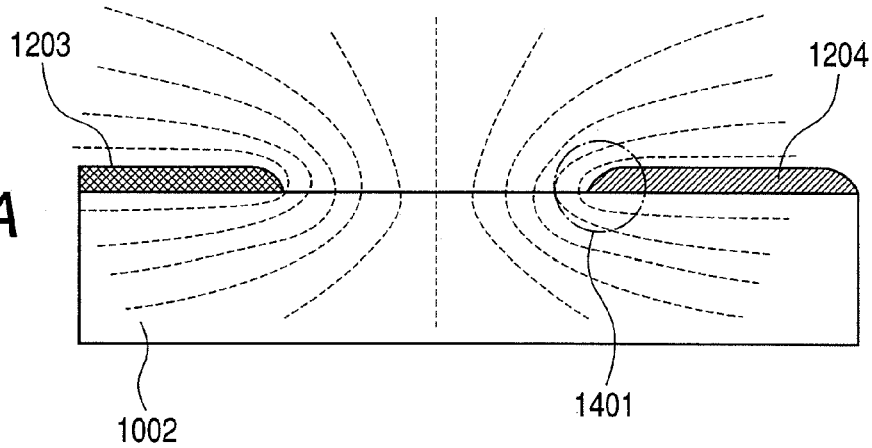
FIGS. 1A, 1B, and 1C are schematic explanatory sectional views each showing a light-emitting substrate including a dielectric film in the present invention.
Figure 1B:
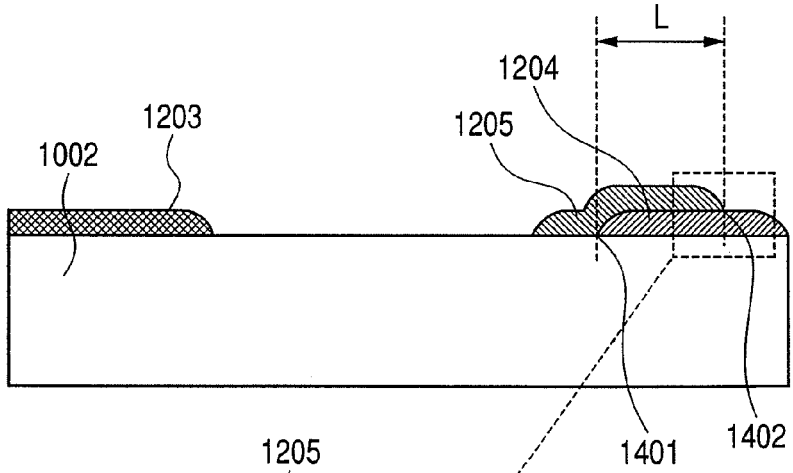
Figure 1C:
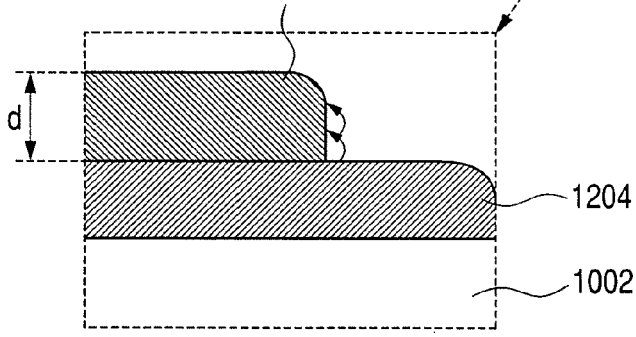
Figure 6:
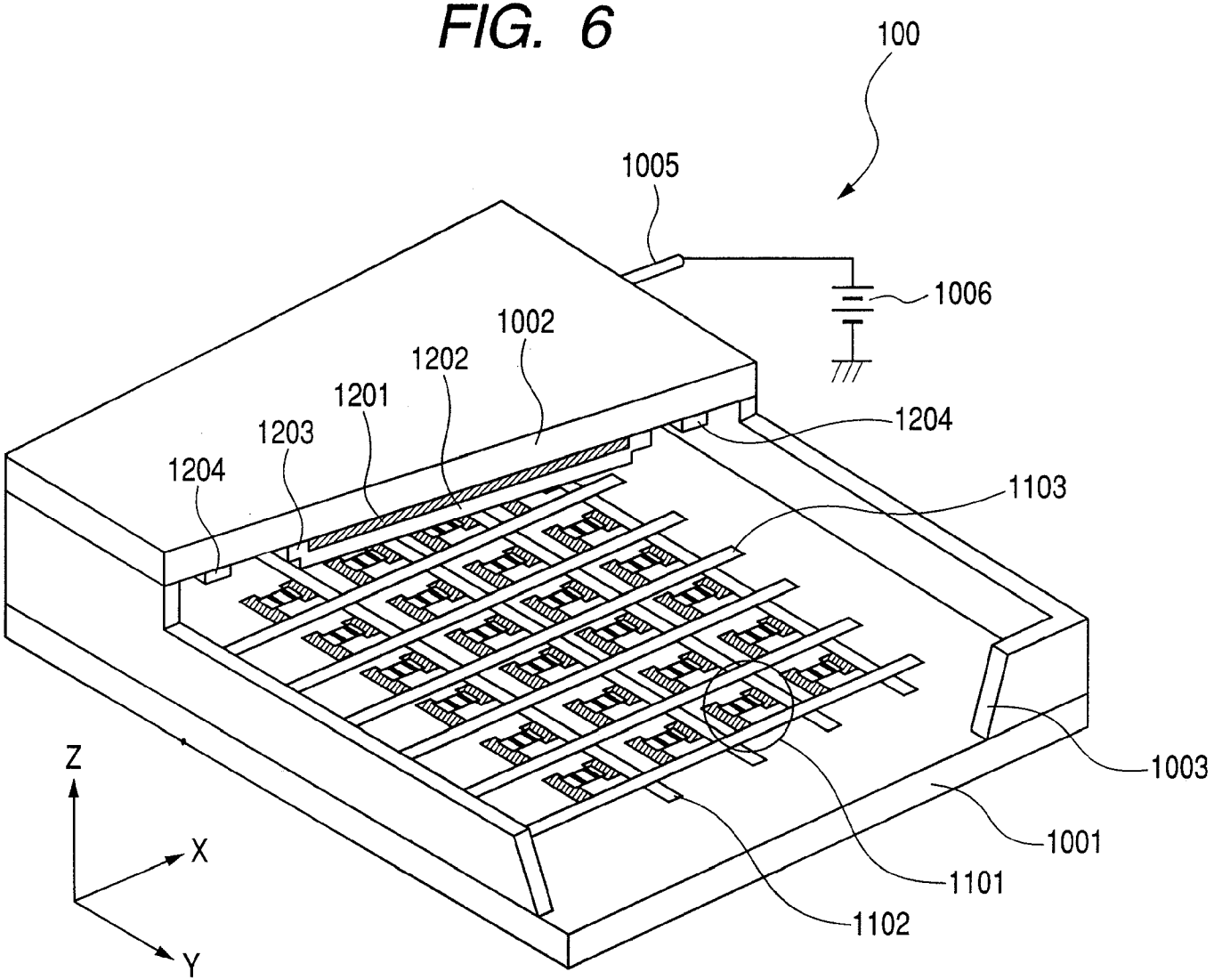
FIG. 6 is a schematic perspective view showing an image display apparatus to which the light-emitting substrate according to the present invention is applied.
Figure 7:
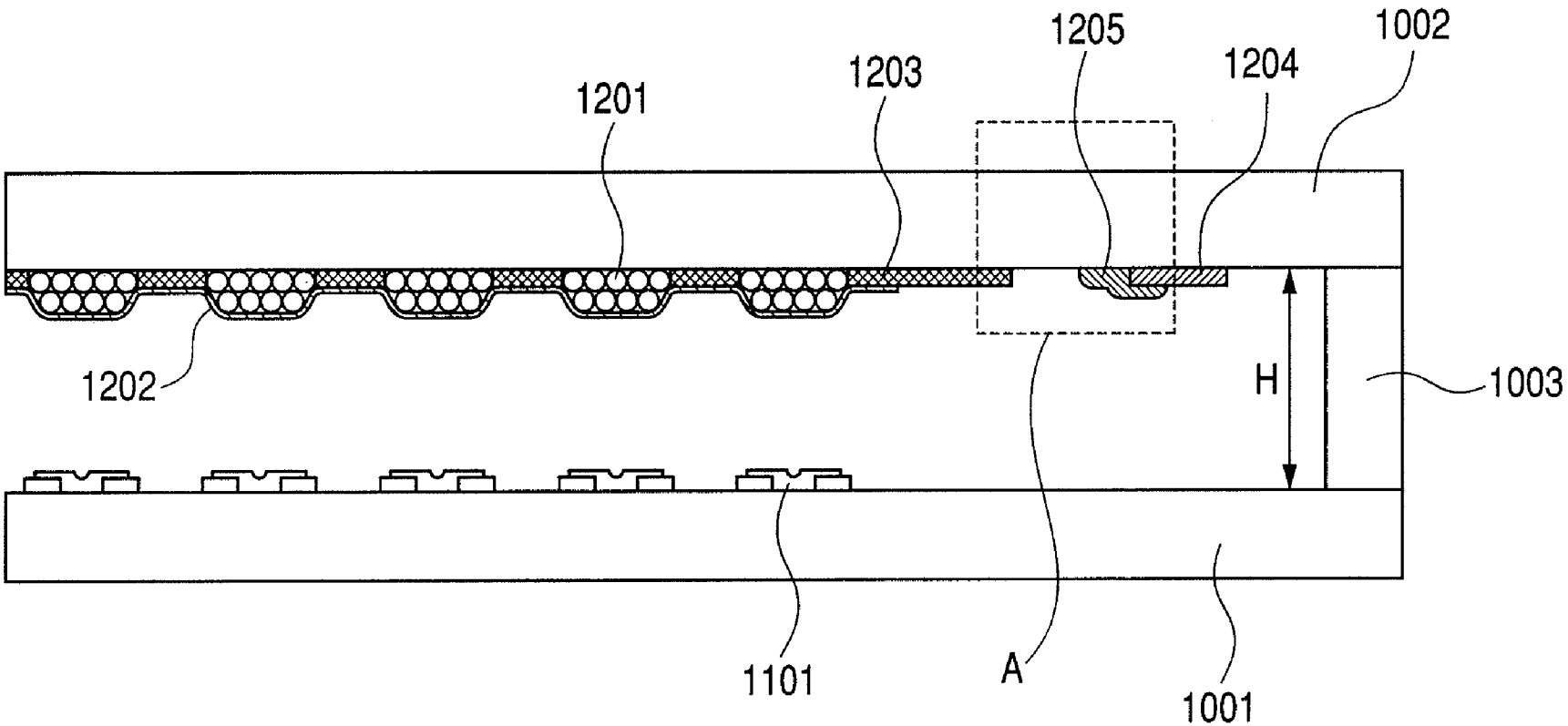
FIG. 7 is a schematic sectional view showing the image display apparatus to which the light-emitting substrate according to the present invention is applied.

FIG. 6 is a schematic view showing an example of an airtight container 100 which is a portion of an image display apparatus using a light-emitting substrate according to the present invention. Note that FIG. 6 shows the inner portion of the airtight container 100 which is partially omitted to make it clear. FIG. 7 is a schematic sectional view showing the portion of the image display apparatus which is shown in FIG. 6. FIG. 1B is a schematic enlarged view showing a A-region surrounded by a dotted line in FIG. 7. Note that the FIG. 1B and a A-region surrounded by a dotted line in FIG. 7 is upside down. FIG. 1C is a schematic enlarged view showing a region surrounded by a dotted line in FIG. 1B.

In FIGS. 6 and 7, a rear plate 1001 includes a large number of electron-emitting devices 1101 which are arranged thereon. Each of the electron-emitting devices 1101 is connected with one of X-directional wirings 1103 and one of Y-directional wirings 1102. Although FIG. 6 shows an example in which a surface conduction electron-emitting device is used as each of the electron-emitting devices 1101, an electron-emitting device which can be applied to the image display apparatus in the present invention is not limited in principle to this. In addition to the surface conduction electron-emitting device, an MIM electron-emitting device, an MIS electron-emitting device, or a field emission electron-emitting device can be used as each of the electron-emitting devices. A field emission electron-emitting device including electron emitters, each of which is made of metal or semiconductor and formed in a conical shape or a quadrangular pyramid shape (so-called spindt type field emission electron-emitting device) can be preferably used as the field emission electron-emitting device. Alternatively, it is possible to use a field emission electron-emitting device using as an electron emitter a carbon fiber having a nano-sized diameter, such as a carbon nanotube or a graphite nanofiber.

In FIGS. 6 and 7, a face plate 1002 is composed of a transparent insulating substrate. A glass substrate is typically used as the face plate 1002. In order to be able to display an image with an aspect ratio of 4:3 or 16:9, a face plate whose outer periphery has substantially a quadrangular shape, particularly a rectangular shape is preferably used.

A light-emitting member 1201 including light-emitting regions (131, 132, and 133 (described later with reference to FIG. 10)), an anode electrode 1202 serving as a first electroconductive film, and a second electroconductive film 1204 are arranged on the face plate 1002. The light-emitting member is typically composed of a phosphor. The anode electrode 1202 and the light-emitting member 1201 are overlapped with each other. In order to be able to display the image with the aspect ratio of 4:3 or 16:9, the light-emitting member 1201 and the anode electrode 1202 whose outer peripheries each have substantially a quadrangular shape, particularly a rectangular shape are preferably used. Therefore, it is preferable that the outer periphery of the anode electrode 1202 have substantially a quadrangular shape.

In the example described here, the anode electrode 1202 is provided on the light-emitting member 1201, so it is composed of a thin electroconductive film. The anode electrode 1202 which is provided on the light-emitting member 1201 and located on the side closer to the electron-emitting devices 1101 than the light-emitting member 1201 corresponds to a so-called "metal back".

The anode electrode (metal back) 1202 has, for example, a function of making the electrons, which is emitted from the electron-emitting devices 1101, pass through itself and of colliding electrons emitted from the electron-emitting devices 1101 with the light-emitting member 1201. The anode electrode (metal back) 1202 has also a function of reflecting light emitted from the phosphor to the rear plate side toward the face plate 1002 side. In order to realize the functions, an electroconductive film having a metallic luster, that is, a metallic film is preferably used for the metal back 1202. The electrons excite the light-emitting member 1201 through the metal back 1202, so a part of the energies thereof are lost by the metal back 1202. When the energy loss is to be reduced, it is preferable to use an aluminum film whose energy loss is small for the metal back. A filming process which is a known technique in a CRT field can be employed as a method of producing the metal back 1202 composed of the aluminum film. A film thickness of the aluminum film is 10 nm to 1 μm in practical use. However, the present invention is not limited to this range.

It is preferable that the metal back 1202 cover the light-emitting member 1201. Therefore, a lamination composed of the light-emitting member 1201 and the metal back 1202 is located on the face plate 1002.

In the present invention, a member corresponding to the anode electrode can be referred to as the "first electroconductive film". In the above-mentioned example, the metal back 1202 becomes the "first electroconductive film". In some cases, the first electroconductive film is located between the phosphor 1201 and the face plate 1002.

When discharge is caused between the first electroconductive film 1202 and the rear plate 1001 (electron-emitting devices 1101 and the wirings 1103 and 1102) opposed thereto, a large current corresponding to charges accumulated in a capacitance formed by the first electroconductive film 1202 and the rear plate 1001 flows therebetween, so that the image display apparatus suffers fatal damage. Note that the current increases in proportion to a display area of the image display apparatus. Therefore, it is preferable that the first electroconductive film (metal back 1202) be composed of a plurality of electroconductive films. In that case, the plurality of electroconductive films are connected in parallel through resistors, preferably. When an area of each of the electroconductive films composing the first electroconductive film is reduced, it is possible to lower a capacitance produced between each of the electroconductive films and the rear plate 1001. As a result, a discharge current can be decreased to reduce discharge damage to the image display apparatus.

In the present invention, the face plate 1002 including the phosphor 1201, the anode electrode (first electroconductive film) 1202, and the second electroconductive film 1204 is referred to as the "light-emitting substrate".

A side wall 1003 is located between the face plate 1002 and the rear plate 1001. The face plate 1002, the rear plate 1001, and the side wall 1003 are airtightly bonded to one another and an inner space produced by the bonding is evacuated to produce the airtight container 100. The airtight container 100 is maintained at a reduced state (vacuum state). The airtight container 100 is preferably maintained at the degree of vacuum of preferably $10^{-7}$ Pa or more. The degree of vacuum of $10^{-7}$ Pa can be reduced according to, for example, the type of the used electron-emitting device.

Figure 10:
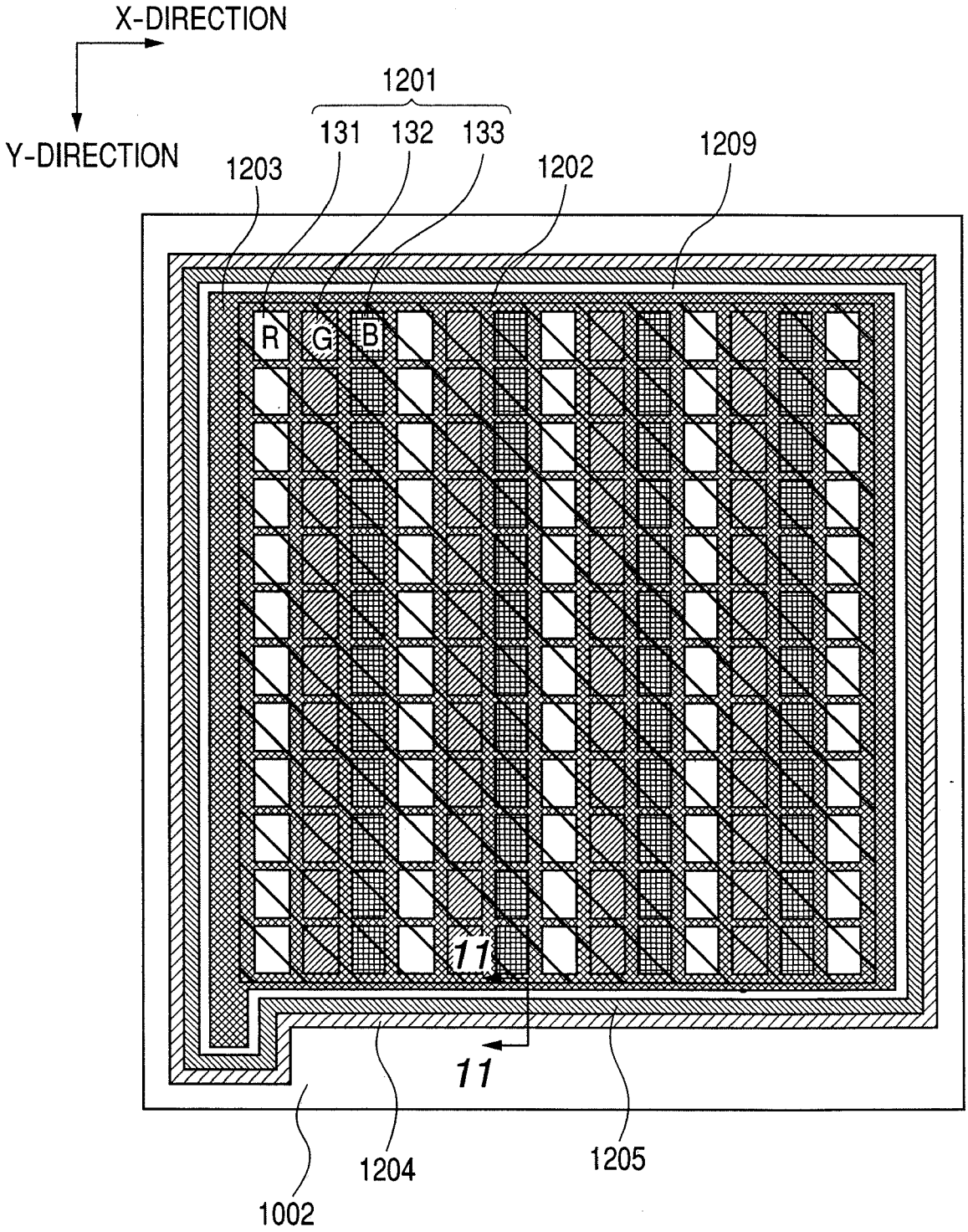
FIG. 10 is a schematic explanatory plan view showing the light-emitting substrate according to the present invention.

FIG. 10 is a schematic view showing the inner portion of the airtight container 100 when the face plate 1002 side is viewed from the rear plate 1001 side. In FIG. 10, to make understanding easy, a region corresponding to the metal back (first electroconductive film) 1202 is indicated by diagonal lines. FIG. 1B is not only the enlarged view of the A-region shown in FIG. 7 but also the schematic view of a cross section along a line 11-11 shown in FIG. 10.

In the example described here, as shown in FIG. 10, the light-emitting member (phosphor) 1201 includes the light-emitting regions (the phosphor regions) 131 for emitting red light, the light-emitting regions (the phosphor regions) 132 for emitting green light, and the light-emitting regions (the phosphor regions) 133 for emitting blue light. A light absorbing member (typically black member) 1203 which is called a "black matrix", a "black stripe" or the like is located between the respective phosphor regions (131 to 133). Each of the light-emitting regions can be composed of typically a plurality of fluorescent material particles. The light-emitting regions 131 for red, the light-emitting regions 132 for green, and the light-emitting regions 133 for blue are repeatedly arranged on the face plate 1002 at predetermined cycles. In the present invention, it is preferable to form the outer periphery of the light-emitting member 1201 in substantially a quadrangular shape.

Although the light absorbing member (typically black member) 1203 is not necessarily provided, it is preferably provided to improve the quality of a display image. In the example shown in FIG. 10, the light absorbing member 1203 is formed in a grid shape and a so-called "black matrix" structure is used therefor. In other words, the example of FIG. 10 shows a structure in which the light absorbing member 1203 in which a large number of opening portions corresponding to regions in which the light-emitting regions (131 to 133) are located are formed in a grid shape (lattice shape or matrix shape) and the light-emitting regions (131 to 133) located in the respective openings are arranged on the face plate 1002. When the above-mentioned "black stripe" structure is employed, the light absorbing member 1203 is extended in any one of the X-direction and the Y-direction. That is, the light-emitting regions (131 to 133) are separated from one another in the X-direction (or Y-direction) by the light absorbing member 1203 but not separated from one another in the Y-direction (or X-direction) by the light absorbing member 1203. For example, carbon black or low-melting glass containing a black pigment can be used for the light absorbing member 1203. The light-emitting member 1201 can be formed by a screen printing method or a photolithography method.

In the present invention, the light absorbing member 1203 can be also made of an electroconductive material. In such a case, the potential of the light absorbing member 1203 is maintained to a potential substantially equal to the potential of the metal back 1202. Therefore, a combination of the metal back 1202 and the light absorbing member 1203 functions as the anode electrode. That is, the first electroconductive film corresponding to the anode electrode is composed of the metal back 1202 and the light absorbing member 1203. Of course, when the light absorbing member 1203 is made of an insulator, the member that functions as the anode electrode becomes the metal back 1202, so that the metal back 1202 becomes the first electroconductive film.

The metal back 1202 is a very thin film having a thickness less than 1 μm (typically, 50 nm to 400 nm). Therefore, it is preferable that the light absorbing member 1203 be made of the electroconductive material because the uniformity of the potential of the metal back 1202 can be maintained to a high degree over the entire surface of the metal back. In view of a forming method, the metal back 1202 is hard to specify the shape of a peripheral portion thereof in some cases. Therefore, the light absorbing member 1203 which can be formed using a photolithography method or the like is made of the electroconductive material, so that the end shape of the anode electrode can be controlled/specified with high precision. As a result, it is possible to improve the controllability of an electric field within an image display region of the airtight container 100 and the reproducibility of manufacturing an image display apparatus. When the light absorbing member 1203 is to be made of an electroconductive material, electroconductive paste containing a metallic particle such as silver and low-melting glass, carbon black, or the like can be used as the material. In order to improve the function as the light absorbing layer, black pigment is contained in the light absorbing member 1203 in some cases.

In the example shown in FIG. 10, the area of the light absorbing member 1203 is larger than the area of the metal back 1202. The area of the light absorbing member 1203 is not necessarily set to be larger than the area of the metal back 1202. However, the light absorbing member 1203 is formed at a thickness larger than that of the metal back 1202. Therefore, when the light absorbing member 1203 is made of the electroconductive material as described above, it is also allowed to function as a stable connector with a high voltage terminal 1005 for supplying a potential from a power source 1006 to the metal back 1202. When the area of the light absorbing member 1203 is set to be larger than the area of the metal back 1202 (outer periphery (circumference) of the metal back 1202 is located inside the outer periphery (circumference) of the light absorbing member 1203), a portion of the light absorbing member 1203 which is not covered with the metal back 1202 can be used as a connection portion with the high voltage terminal 1005 for supplying a potential to the anode electrode (first electroconductive film). The connection portion with the high voltage terminal 1005 corresponds to a protruding portion located at the lower left in FIG. 10. Although the protruding portion is located at the lower left in FIG. 10, the area of the protruding portion is slight as compared with the area of the anode electrode. Thus, the anode electrode having such a structure can be also said to be the anode electrode including substantially the quadrangular outer periphery.

In the image display apparatus according to the present invention, an anode voltage (Va) is applied from the power source 1006 to the first electroconductive film (anode electrode) through the high voltage terminal 1005 (see FIG. 6). Note that the power source 1006 may be composed of a means for adjusting a voltage supplied from a plug (such as a household wall plug) to the anode voltage (Va) or composed of a means for generating the anode voltage (Va). A practical range of the anode electrode (Va) is a range of typically 5 kV to 30 kV, preferably 10 kV to 25 kV based on a potential applied to the electron-emitting device 1101 on the rear plate 1001 and the anode voltage is selected as appropriate from the range.

In one embodiment of the present invention, in order to suppress discharge in a region outside the first electroconductive film, the second electroconductive film 1204 is located so as to surround the outer periphery (circumference) of the first electroconductive film (see FIG. 10). Further, in the present invention, the second electroconductive film 1204 is designed so as not to be directly connected with the first electroconductive film (anode electrode). That is, the first electroconductive film and the second electroconductive film 1204 are located at an interval. That is, also, the second electroconductive film 1204 is located around the first electroconductive film with an interspace. A region 1209 corresponding to the interspace (interval) is not covered with the second electroconductive film 1204 and the first electroconductive film (anode electrode) (not covered with the electroconductive films) and the surface of the face plate 1002 which is a generally high-insulating member is preferably exposed. The interval between the first electroconductive film and the second electroconductive film is set to preferably 0.5 mm to 10 mm, more preferably 1 mm to 5 mm.

A potential of the second electroconductive film 1204 is set to be closer to a surface potential of the rear plate 1001 than the potential of the anode electrode (anode voltage). That is, the voltage applied to the second electroconductive film 1204 is set to be lower than the anode voltage. More preferably, when the image display apparatus is driven, the potential applied to the electron-emitting device 1101 and the potential applied to the second electroconductive film 1204 are set such that a difference therebetween becomes 1 kV or less. The potential of the second electroconductive film 1204 may be typically within a range of a voltage applied when the electron-emitting device is driven (typically −50 V to +50 V). It is more preferable to specify the potential of the second electroconductive film 1204 to a GND potential because of convenience. When such setting is made, an electric field outside the second electroconductive film 1204 can be significantly weakened as compared with an electric field in a region caused by orthogonal projection to the first electroconductive film (image display region). Therefore, it is possible to prevent discharge resulting from discharge elements (such as foreign matters and protrusions) which are present outside the region included when the first electroconductive film (anode electrode) is orthogonally projected from the face plate 1002 side to the rear plate side 1001 side.

In the present invention, as shown in FIG. 10 it is most preferable that the second electroconductive film 1204 is composed of an electroconductive film having a closed annular shape (closed loop shape or closed ring shape) provided along the four respective sides composing the quadrangular outer periphery of the anode electrode. Therefore, the second electroconductive film 1204 having the closed annular shape preferably includes a quadrangular inner periphery substantially similar to the outer periphery of the anode electrode such that a distance from the outer periphery of the anode electrode substantially becomes constant. It is preferable that the second electroconductive film 1204 have a quadrangular outer periphery similar to the inner periphery of the second electroconductive film 1204. The quadrangular inner periphery of the second electroconductive film and the quadrangular outer periphery of the first electroconductive film (anode electrode) are located at a suitable distance. In such a case, the outer periphery of the first electroconductive film and the outer periphery of the second electroconductive film are substantially similar to each other. As described above, the protruding portion is located at the lower left in the structure of the anode electrode as shown in FIG. 10. However, the entire structure can be assumed to have substantially a quadrangular shape. Thus, the anode electrode side end (inner periphery) of the second electroconductive film 1204 which is provided along the outer periphery of the anode electrode can be also assumed to have substantially a quadrangular shape.

Figure 14:
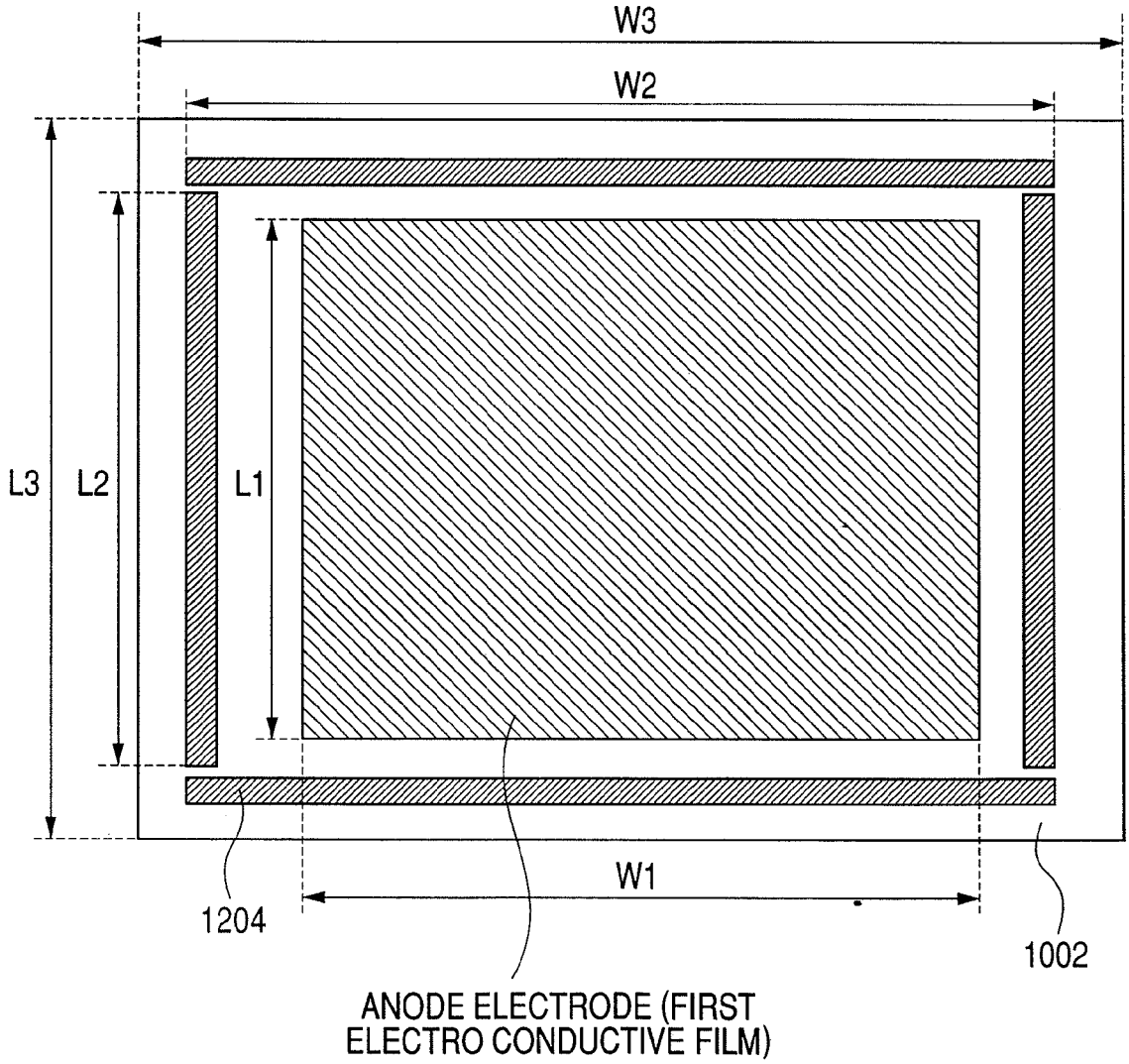
FIG. 14 is a schematic explanatory plan view showing another structural example of a second electroconductive film in the light-emitting substrate according to the present invention.

FIG. 10 shows the example in which the second electroconductive film 1204 having the strip shape is formed such that the quadrangular inner periphery thereof completely surrounds the quadrangular outer periphery of the first electroconductive film (metal back 1202). In the present invention, as shown in FIG. 14, for example, the second electroconductive film 1204 having the annular shape may be formed to provide disconnection portions (gaps) at four corners of the quadrangular inner periphery. In such a case, four electroconductive film strips of the second electroconductive film 1204 are provided along the respective sides composing substantially the quadrangular outer periphery of the first electroconductive film (anode electrode). A potential lower than the potential of the anode electrode is applied to each of the electroconductive film strips of the second electroconductive film 1204. When the gaps are to be provided at the four corners, it is preferable to employ a structure in which the outer periphery of the face plate is not viewed from the anode electrode side in view of the stability of a potential on the face plate (in view of discharge suppression). As described above, in the present invention, the second electroconductive film 1204 has preferably the annular shape as shown in FIG. 14, particularly preferably the closed annular shape (closed loop shape) as shown in FIG. 10. Although the case where the gaps are provided at the four corners is described here, the positions of the gaps to be provided are not limited to the four corners.

Figure 12:
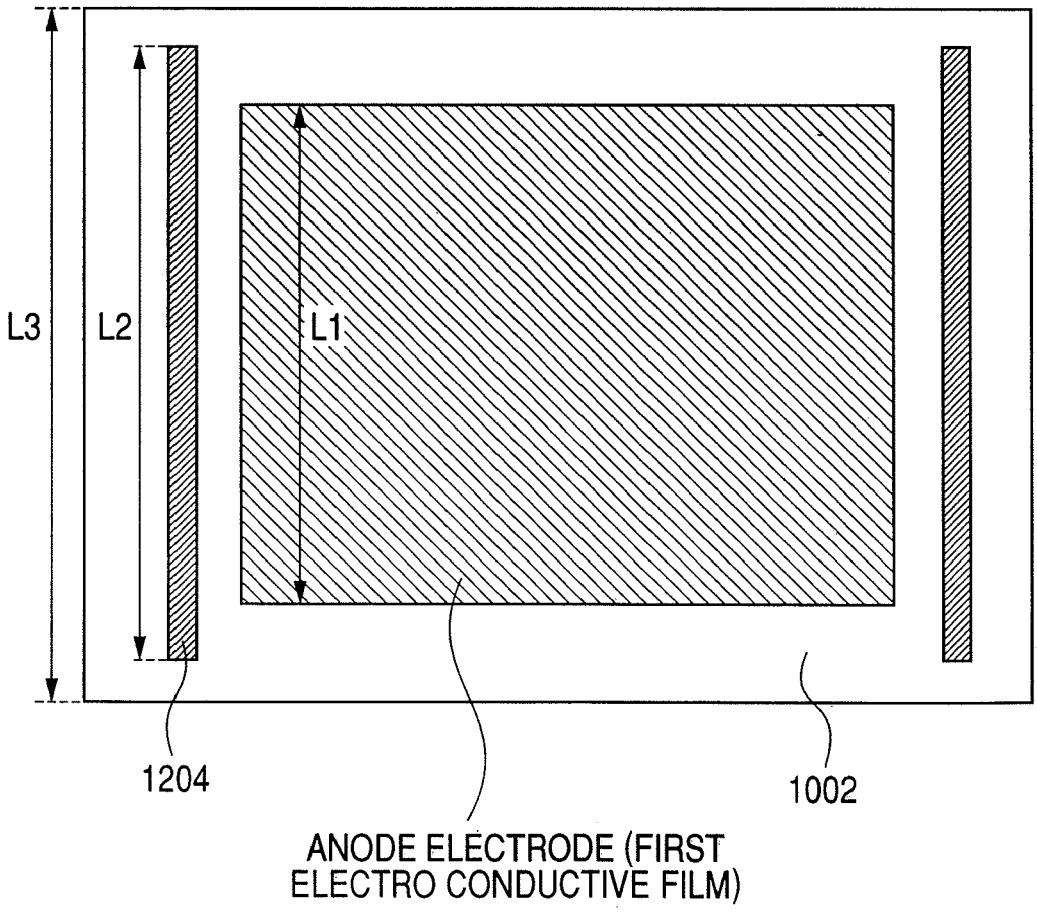
FIG. 12 is a schematic explanatory plan view showing a structural example of a second electroconductive film in the light-emitting substrate according to the present invention.
Figure 13:
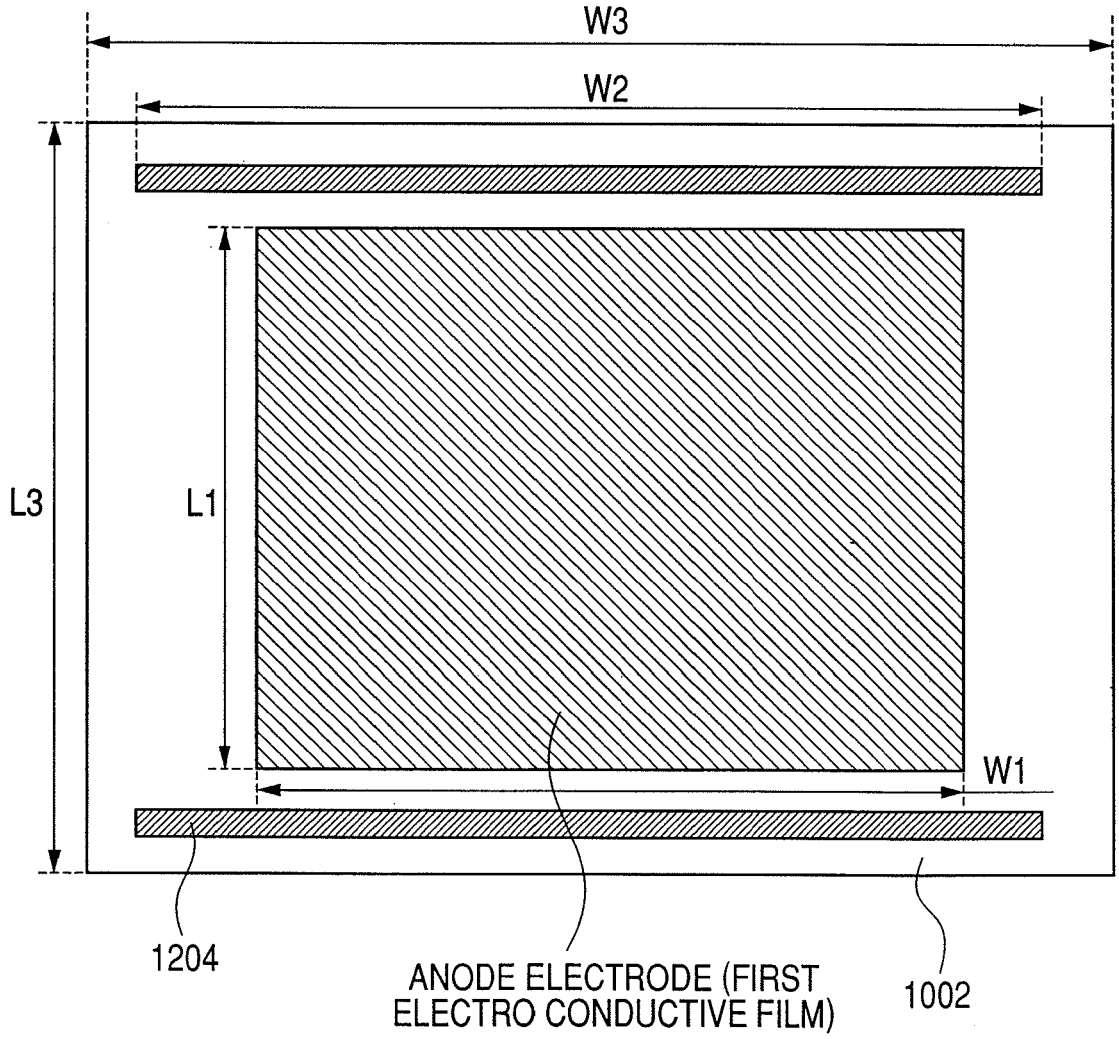
FIG. 13 is a schematic explanatory plan view showing another structural example of a second electroconductive film in the light-emitting substrate according to the present invention.

In another structure of the second electroconductive film in the present invention, as shown in FIG. 12 or 13, the second electroconductive film 1204 can be located so as to sandwich at least two opposite sides of the four sides composing the quadrangular outer periphery of the anode electrode. That is, the second electroconductive film 1204 is composed of the two electroconductive film strips provided along the two opposite sides of the anode electrode. The anode electrode is sandwiched between the two electroconductive film strips. Even in this case, the anode electrode is not connected with the two electroconductive film strips through electroconductive films (gaps are provided). When the structure shown in FIG. 12 or 13 is employed, the anode electrode is not surrounded by the second electroconductive film. However, the outer periphery of the anode electrode is surrounded by an equipotential line produced based on the potential applied to the second electroconductive film 1204 (equipotential line passing through the second electroconductive film 1204) within the surface of the face plate 1002.

In the case as shown in FIG. 12 or 13, in view of the stability of a potential on the face plate (in view of discharge suppression), it is preferable that a length L2 (W2) of each of the two electroconductive film strips be set to be longer than a length L1 (W1) of each of the two opposite sides sandwiched (surrounded) by the electroconductive film strips, of the four sides composing the outer periphery of the anode electrode. The length L2 (W2) of each of the two electroconductive film strips is preferably set to be shorter than a length L3 (W3) of each of two opposite sides located near the electroconductive film strips, of the four sides composing the quadrangular outer periphery of the face plate 1002.

In the present invention, when the second electroconductive film 1204 is composed of the plurality of electroconductive films as described above, the potentials applied to the plurality of electroconductive films are set to be substantially equal to each other.

As described with reference to FIGS. 10 and 12 to 14, in the present invention, at least the anode electrode is sandwiched by the second electroconductive film 1204. The length of the second electroconductive film 1204 is set as appropriate according to the length of a side of the outer periphery of the anode electrode, the distance between the anode electrode and the second electroconductive film 1204, the potential applied to the anode electrode, the potential applied to the second electroconductive film 1204, and the like. In the present invention, even when any one of the structures shown in FIGS. 10, 12 to 14 is employed, the outer periphery of the anode electrode is surrounded by the equipotential line produced based on the potential applied to the second electroconductive film 1204 (equipotential line passing through the second electroconductive film 1204) within the surface of the face plate 1002.

The second electroconductive film 1204 may be made of an electroconductive material. Electroconductive paste containing a metallic particle such as silver and low-melting glass, carbon black, or the like can be used as the electroconductive material. When the light absorbing member 1203 is made of the electroconductive material, the second electroconductive film 1204 can be formed using the same material as that of the light absorbing member 1203 simultaneously with the formation of the light absorbing member 1203. The second electroconductive film 1204 can be formed by a screen printing method or a photolithography method.

As described above, when the light absorbing member 1203 is made of the electroconductive material, the first electroconductive film (anode electrode) is composed of the metal back 1202 and the light absorbing member 1203. Then, when the area of the light absorbing member 1203 made of the electroconductive material is larger than the area of the metal back 1202 (the outer periphery of the metal back 1202 is located inside the outer periphery of the light absorbing member 1203), the second electroconductive film 1204 is formed so as to surround the outer periphery of the light absorbing member 1203 as shown in FIG. 10. When the light absorbing member 1203 is made of a material having sufficient insulating property, the light absorbing member 1203 may be extended below the second electroconductive film 4204. That is, in such a structure, the first electroconductive film (metal back 1202) and the second electroconductive film 1204 are located at an interval on the light absorbing member 1203.

In general, the insulating property of the glass substrate composing the face plate is high. Therefore, in view of suppressing discharge in the outer end of the first electroconductive film, as compared with the fact that the insulating property between the first electroconductive film (metal back) and the second electroconductive film 1204 is ensured by the light absorbing member 1203, it is preferable that the second electroconductive film 1204 be formed so as to surround the outer periphery of the light absorbing member 1203 at a distance from the outer periphery of the light absorbing member 1203 as shown in FIGS. 10 and 12 to 14.

When an electroconductive member corresponding to the anode electrode (electroconductive member to which the anode voltage is applied) is provided on the face plate 1002 in addition to the metal back 1202 and the light absorbing member 1203, a film including the electroconductive member corresponding to the anode electrode can be referred to as the "first electroconductive film" in the present invention.

In addition to the above-mentioned structures of the light-emitting substrate, for example, in order to improve the stability of the potential of the anode electrode, it is possible to use a structure in which a transparent electroconductive film made of ITO, tin oxide, or the like is provided between a layer (composed of the light-emitting member 1201 and the light absorbing member 1203) and the face plate (glass substrate) 1002. The transparent electroconductive film can be formed using a vapor phase process such as a sputtering method or a vacuum evaporation method or a liquid phase process using a fine particle dispersion solution, such as spray coating, spin coating, dipping, slit coating, or a sol-gel method. When the transparent electroconductive film instead of the metal back 1202 is formed as the anode electrode, the function as a light reflecting layer such as the metal back cannot be provided to the transparent electroconductive film. However, the structure is simplified, so a manufacturing cost can be reduced.

As described above, the anode electrode ("first electroconductive film") in the present invention is not limited to only a combination of the metal back 1202 and the light absorbing member 1203.

In the present invention, the end portion of the second electroconductive film 1204 which is opposed to the first electroconductive film (anode electrode) is covered with a dielectric film 1205.

The dielectric film 1205 covering the end portion of the second electroconductive film 1204 will be described below in detail with reference to FIGS. 1B and 1C which are enlarged views each showing the A-region of FIG. 7. FIG. 1A shows the case where the dielectric film 1205 is removed from the structure shown in FIG. 1B. FIG. 1C is an enlarged view showing a region surrounded by a dotted line of FIG. 1B. In order to exhibit an effect of the dielectric film 1205, the trajectory of an electron is indicated by an arrow.

In FIGS. 1B and 1C, to make the description easy, the first electroconductive film (anode electrode) is indicated by reference numeral 1203. In other words, FIGS. 1B and 1C show the case where the light absorbing member 1203 is made of the electroconductive film and the outer periphery of the metal back 1202 is located inside the outer periphery of the light absorbing member 1203 as shown in FIG. 10. As described above, in the present invention, for example, there are the case where the first electroconductive film (anode electrode) is composed of the metal back 1202, the case where the first electroconductive film is composed of the metal back 1202 and the light absorbing member 1203, and the case where the first electroconductive film is composed of the metal back 1202, the light absorbing member 1203, and another member. In any case, FIGS. 1B and 1C each schematically show only the end of the first electroconductive film (anode electrode) which is located on the second electroconductive film 1204 side.

The dielectric film 1205 in the present invention has a function of suppressing the occurrence of discharge (particularly surface discharge) between the first electroconductive film (anode electrode) and the second electroconductive film 1204 in a vacuum.

When the dielectric film 1205 is not provided (see FIG. 1A), the surface discharge in a vacuum may be caused by repeating (1) the emission of electron from the second electroconductive film 1204 having the potential lower than that of the first electroconductive film (anode electrode) 1203, (2) positive charging on the surface of the dielectric 1002 which is caused by the irradiation of the dielectric 1002 with the emitted electron, and (3) additional emission of electron from the second electroconductive film 1204 which is caused by an increase in potential of the dielectric.

In other words, according to a phenomenon in which the field emission electron from the second electroconductive film 1204 travels to the first electroconductive film 1203 while causes multiple scattering in the surface (surface portion) of the dielectric 1002 (secondary electron emission avalanche), discharge may be led by the repetition of positive feedback in which the surface of the dielectric 1002 is positively charged to further increase an electric field strength near the second electroconductive film 1204. It is assumed that the amount of field emission electrons from the second electroconductive film 1204 is determined according to an electric field strength on the surface of the second electroconductive film 1204.

Dotted lines in FIG. 1A schematically indicate equipotential lines produced when a potential lower than the potential applied to the anode electrode 1203 is applied to the second electroconductive film 1204. In the structure in which the electrodes (1203 and 1204) are located on the dielectric (1002), an interval between the equipotential lines becomes narrower in the vicinities of the ends of the electrodes (electric field strength becomes stronger). As a result, an electric field concentration region 1401 (an end portion of the second electroconductive film 1204) which is a region surrounded by an alternate long and short dashed circle of FIG. 1A is caused. According to such a shape, there is the case where a so-called field multiplication factor β reaches 100 to 1000 or more. Here, the field multiplication factor indicates the degree of electric field at the electric field concentration region 1401 to an average electric field strength (numerical value obtained by dividing a potential difference between the first electroconductive film (anode electrode) 1203 and the second electroconductive film 1204 by a distance between the first electroconductive film and the second electroconductive film).

Figure 16A:
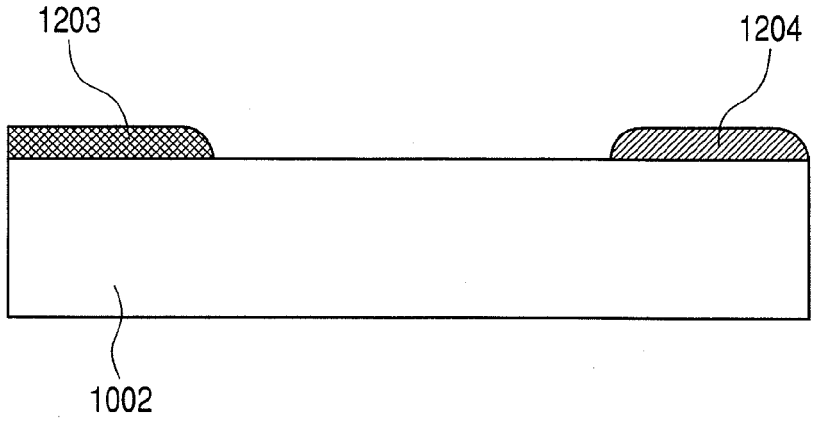
FIGS. 16A, 16B, and 16C are schematic views including a plan view showing a planar shape of the second electroconductive film in the present invention.
Figure 16B:
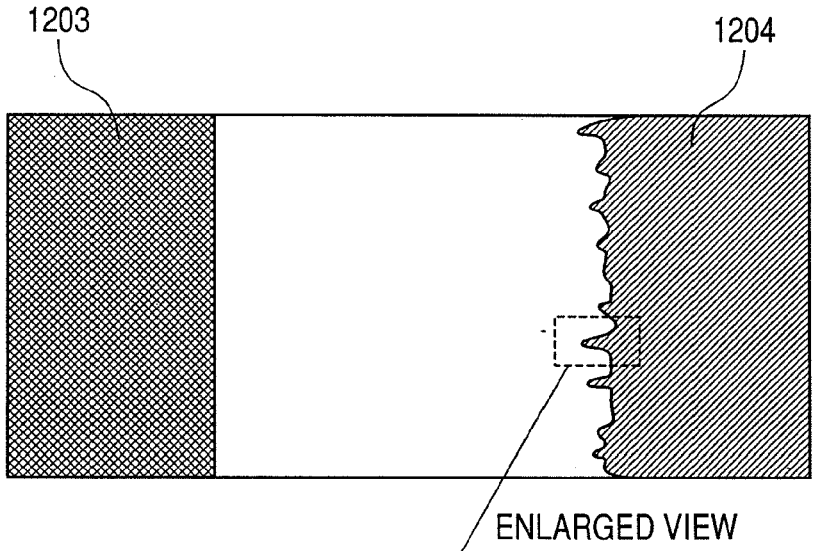
Figure 16C:
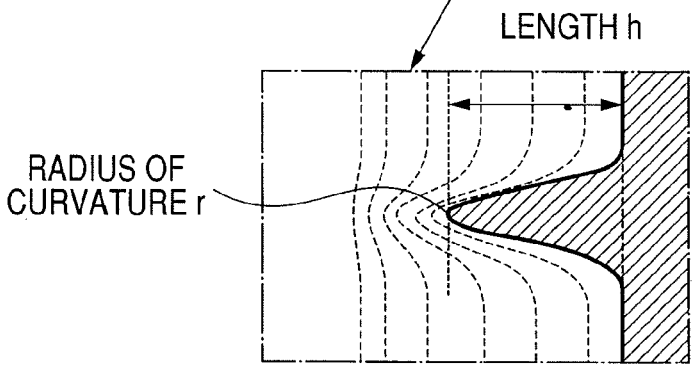
Figure 17A:
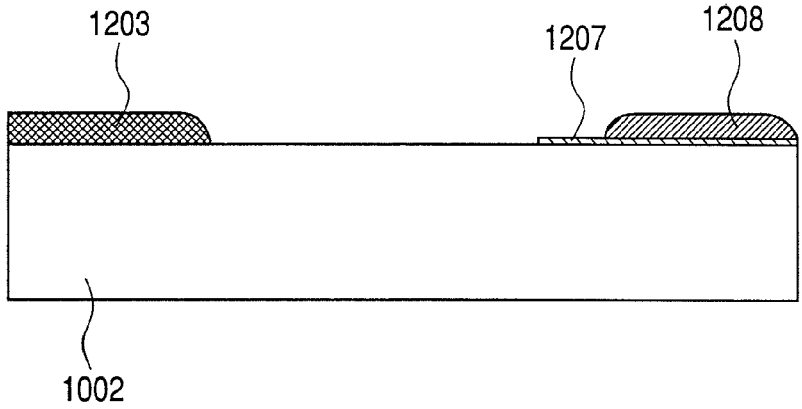
FIGS. 17A, 17B, and 17C are schematic views including a plan view showing a second electroconductive film composed of two kinds of electroconductive members in the present invention.
Figure 17B:
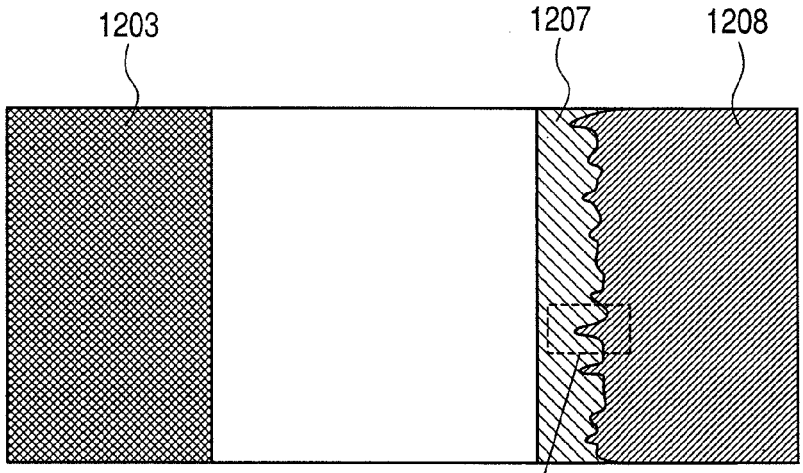
Figure 17C:
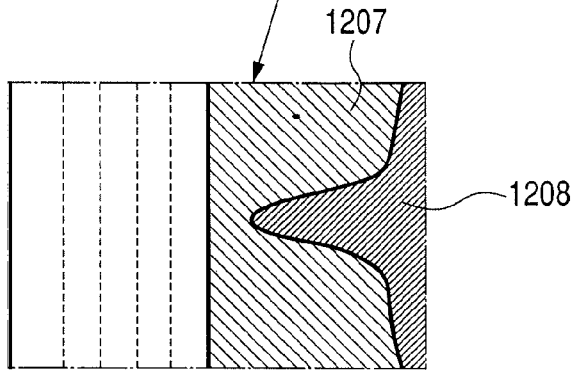

With respect to a factor of increasing the field multiplication factor, there is a planar shape of the end portion of the second electroconductive film 1204 which is opposed to the first electroconductive film 1203. FIGS. 16A, 16B, and 16C each show a state in which unevenness exists in the end portion of the second electroconductive film 1204. FIG. 16C is a schematic enlarged view showing a region surrounded by a dotted line of FIG. 16B. For example, because of the prevention of disconnection due to discharge caused in the ends a thick film process is preferably used for the second electroconductive film 1204. A screen printing method included in the thick film process is suitably used because of efficiency in use of paste and ease in operation. However, in a method such as the screen printing method, as shown in FIG. 16B, there is the case where the end of the second electroconductive film 1204 which is opposed to the first electroconductive film 1203 becomes an unevenness shape. In such a case, FIG. 16C shows a potential distribution when a potential lower than the potential of the first electroconductive film 1203 is applied to the second electroconductive film 1204. In FIG. 16C, a dot line schematically indicates an equipotential line. When a portion convex to the first electroconductive film exists in the end of the second electroconductive film 1204, an interval between the equipotential lines becomes narrower in the vicinity of the tip of the convex portion (electric field strength becomes stronger). In contrast to this, when a plurality of electroconductive films (1207 and 1208) corresponding to the lamination of the second electroconductive film 1204 are formed as shown in FIGS. 17A, 17B, and 17C, it is possible to obtain a structure for preventing electric field concentration. According to such a structure, the end of the second electroconductive film 1204 which is located on the first electroconductive film 1203 side is formed in a stepped shape. For example, when the electroconductive film 1207 is manufactured by a process in which unevenness is not caused in the end of the electroconductive film 1207 shown in FIG. 17A which is located on the first electroconductive film 1203 side, the equipotential lines as shown in FIG. 17C can be produced. As a result, the electric field concentration as shown in FIG. 16C can be prevented. A process for manufacturing the electroconductive film 1207 includes a thin film process. It is possible to suitably use a mask film formation method, a photolithography method, and the like. The degree of electric field concentration resulting from the planar unevenness is expressed by substantially a ratio between a curvature radius r of the tip of a convex shape and a length h of the convex shape (h/r). Therefore, the ratio h/r at any position in the end of the second electroconductive film 1204 which is located on the first electroconductive film 1203 side is preferably 100 or less, more preferably 10 or less. When the ratio is within such a range, the electric field concentration can be reduced.

In the present invention, the end portion of the second electroconductive film 1204 which is opposed to the first electroconductive film (metal back 1202) is covered with the dielectric film 1205 to suppress the occurrence of discharge (particularly surface discharge) based on the following two reasons.

(1) When the electric field concentration region 1401 caused in the case where the dielectric film 1205 is not provided (see FIG. 1A) is covered with the dielectric film 1205, the electric field strength in the region can be reduced and the emission of electron from the electric field concentration region 1401 can be prevented.

(2) Even when an electron is emitted from a triple point 1402 (intersection point among the second electroconductive film 1204, the dielectric film 1205, and a vacuum) newly caused by the formation of the dielectric film 1205 for some reason, the electron trajectory continued until the emitted electron collides with the dielectric film 1205 is short (see FIG. 1C), so the surface of the dielectric film 1205 is negatively charged. Therefore, it is possible to suppress the action of the positive feedback of "(1) the generation of the field electron emission, (2) the increase in electric field strength due to the positive charging of the dielectric, and (3) additional generation of the field electron emission" as described above.

In order to develop the discharge suppression effects the material of the dielectric film 1205 is a dielectric material having large volume resistivity and a material having a high withstand voltage can be suitably used therefor.

It is possible to suitably use the dielectric film 1205 having volume resistivity of practically $10^8$ Ωm or higher, more preferably $10^{12}$ Ωm or higher. When the volume resistivity of the dielectric film 1205 is $10^8$ Ωm or higher, the emission of field electron from the electric field concentration region 1401 can be substantially prevented.

The electric field concentration region 1401 is caused in not only the tip of the end portion of the second electroconductive film which is opposed to the first electroconductive film (anode electrode) but also the vicinity of the tip. Therefore, as shown in FIG. 1B, it is important to cover the surface of the end portion of the second electroconductive film 1204 with the dielectric film 1205 in an area corresponding to a distance L from the tip of the end portion of the second electroconductive film which is opposed to the first electroconductive film (anode electrode).

The inventors et al. of the present invention have conducted concentrated studies and thus found that a region in which an electric field strength becomes larger depends largely on a distance from the opposed substrate (rear plate 1001 in which the electron-emitting devices are arranged). Therefore, when a stacked layer width L (μm) (see FIG. 1B) and a distance H (μm) between the face plate 1002 and the rear plate 1001 are set so as to satisfy $$L \geqq 0.025 \times H + 15$$

a region having a large electric field strength in the end of the second electroconductive film which is opposed to the first electroconductive film (anode electrode) can be effectively covered with the dielectric film 1205. As a result, the field electron emission can be prevented to significantly suppress discharge.

It is necessary to set a thickness d of the dielectric film 1205 (see FIG. 1C) to a thickness in which an electron can collide therewith. Therefore, in view of, for example, the reproducibility of film formation, it is preferable that the film thickness be practically 1 μm or more.

For example, a screen printing method or an application method using a dispenser can be used as a method of applying the paste. It is preferable that the paste contain particularly low-melting glass. When the paste contains the low-melting glass, a backing temperature at the time of formation of the dielectric film 1205 can be reduced, so that the dielectric film 1205 can be easily formed. Another method involving forming the dielectric film 1205 may be a method of fixing or bonding a molded dielectric such as glass onto the second electroconductive film. A resin such as epoxy or polyimide may be used for the dielectric film 1205. In particular, the polyimide is preferable because of its high withstand voltage. A photolithography method is preferably used for the formation of the dielectric film 1205 because a shape of the dielectric film 1205 which is required for suppressing discharge can be obtained with high precision.

As shown in FIG. 10, when a withstand voltage between the second electroconductive film 1204 and the first electroconductive film is to be improved, it is preferable that the entire end portion of the second electroconductive film 1204 which is located on the first electroconductive film side be covered with the dielectric film 1205. However, the present invention does not exclude a structure in which a portion of the end of the second electroconductive film 1204 which is located on the first electroconductive film side is not covered with the dielectric film 1205. As compared with the case where the dielectric film 1205 is not provided (structure shown in FIG. 1A), the end of the second electroconductive film 1204 which is located on the first electroconductive film (anode electrode) side may be covered with the dielectric film 1205 to effectively improve the withstand voltage between the second electroconductive film 1204 and the first electroconductive film.

Figure 8A:
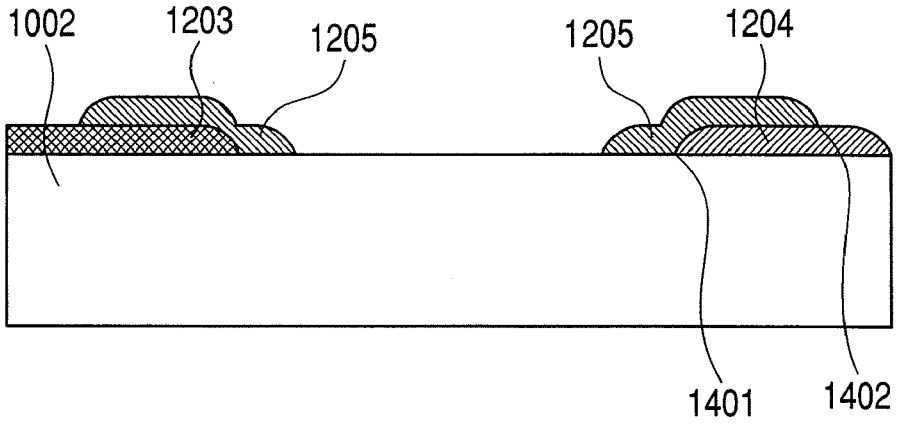
FIGS. 8A and 8B are schematic explanatory sectional views each showing another light-emitting substrate including a dielectric film in the present invention.
Figure 8B:
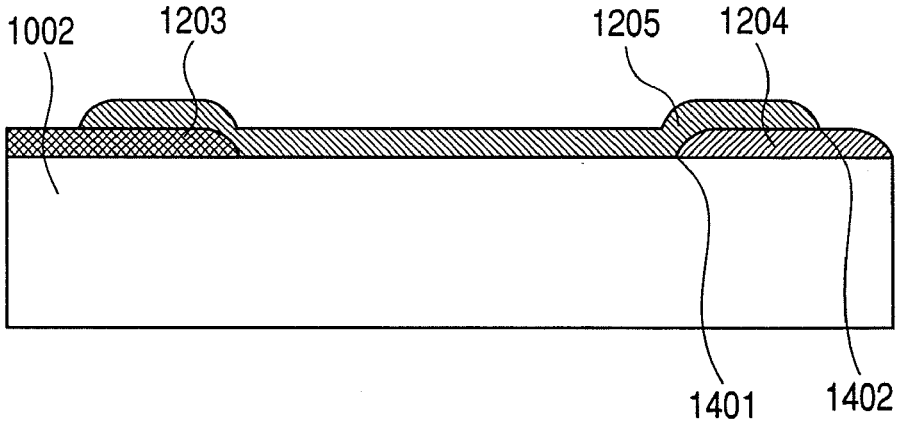

As shown in FIG. 8A or 8B, the end portion of the first electroconductive film (anode electrode) 1203 which is located on the second electroconductive film 1204 side may be covered with the dielectric film 1205 (see FIG. 8A) or the entire region from the end portion of the first electroconductive film (anode electrode) 1203 to the end portion of the second electroconductive film 1204 may be covered with the dielectric film 1205 (see FIG. 8B). Here, there is a high possibility that the dielectric film contains various materials dependent on a formation method. Therefore, it is generally preferable to expose the surface of the glass substrate 1002 which is a member having high insulating property as compared with the case where a space between the first electroconductive film (anode electrode) 1203 and the second electroconductive film 1204 (gap 1209 shown in FIG. 10) is filled with the dielectric film.

The end portion of the first electroconductive film (anode electrode) which is located on the second electroconductive film 1204 side is a portion concentratedly irradiated with electrons generated as a result of field emission from the second electroconductive film 1204 with a high possibility, so a local temperature is likely to increase. When the end portion of the first electroconductive film located on the second electroconductive film side is covered with the dielectric film 1205, electron irradiation portions can be dispersed to prevent an increase in temperature, thereby improving the withstand voltage.

Figure 9:
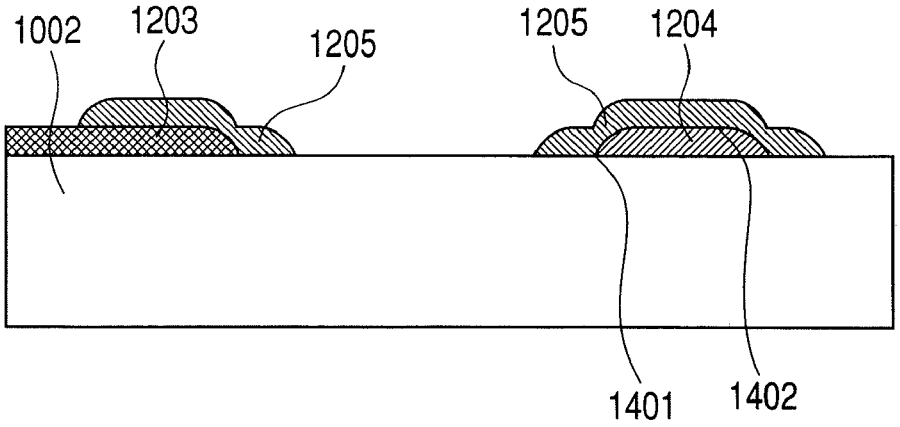
FIG. 9 is a schematic explanatory sectional view showing another light-emitting substrate including a dielectric film in the present invention.

As shown in FIG. 9, a structure in which the second electroconductive film 1204 is completely covered with the dielectric film 1205 may be used. When the surface of the second electroconductive film (at least the end of the second electroconductive film located on the first electroconductive film side and an end opposed thereto) is covered with the dielectric film 1205, the above-mentioned new triple point 1402 can be also covered with the dielectric film 1205. Therefore, an additional discharge suppression effect can be expected. Even in such a case, it is preferable to satisfy the above-mentioned expression with respect to L.

Figure 15A:
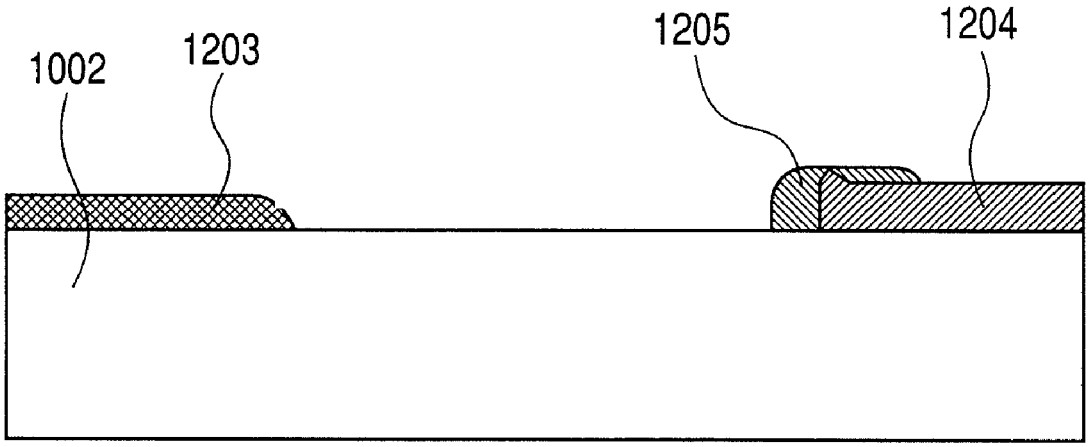
FIGS. 15A and 15B are schematic explanatory sectional views each showing a light-emitting substrate including a dielectric film in the present invention.
Figure 15B:
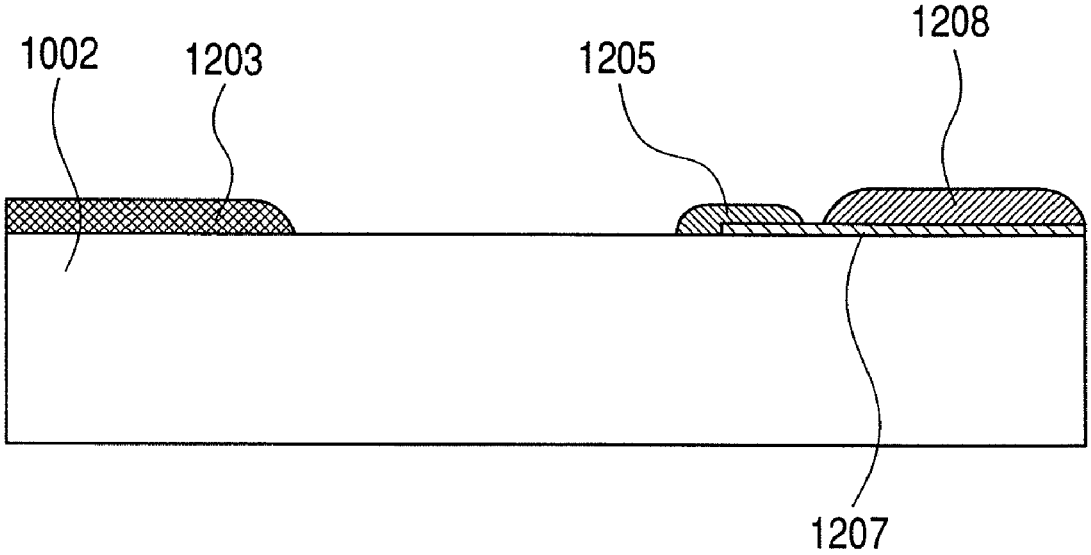

As shown in FIG. 15A, when a portion of the second electroconductive film 1204 on which the dielectric film 1205 is located becomes locally thick or has a steep shape, the step coverage at the formation of the dielectric film 1205 is likely to deteriorate. Therefore, it is preferable that a film thickness of the end of the second electroconductive film 1204 located on the first electroconductive film (anode electrode) side be set to be smaller than an average film thickness of the second electroconductive film 1204. In order to realize the above-mentioned structure of the second electroconductive film, as shown in FIG. 15B, the second electroconductive film 1204 is formed by stacking the plurality of electroconductive films (1207 and 1208) such that the end of the second electroconductive film 1204 located on the first electroconductive film side is composed of the thin electroconductive film (1207). Thus, the dielectric film 1205 can be formed in the end of the second electroconductive film 1204 with high step coverage. In such a structure, for example, the electroconductive film (1208) corresponding to a second layer is stacked on a portion inside the outer periphery (more distant portion from the anode electrode 1203) of the electroconductive film (1207) corresponding to a first layer. Thus, the end of the second electroconductive film 1204 located on the first electroconductive film (anode electrode) 1203 side can be formed in a stepped shape (structure in which the film thickness increases with lengthening a distance from the anode electrode). Such a structure can be realized as follows. For example, the first layer 1207 is formed to be a thin film by a vacuum film formation technique such as a sputtering method and the second layer 1208 is formed to be a thick film by a printing method, a method using a dispenser, or the like. The case where the second electroconductive film 1204 is composed of the two layers is described here. The second electroconductive film 1204 can be composed of three or more electroconductive layers.

Figure 5A:
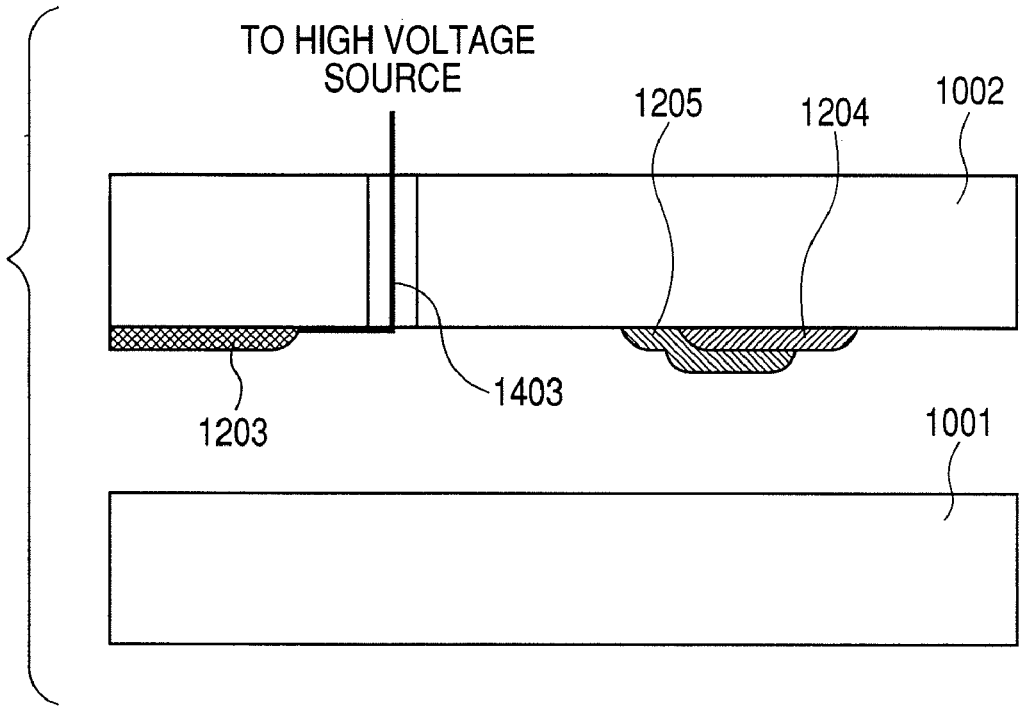
FIGS. 5A and 5B are schematic explanatory sectional views each showing a structure for supplying a potential to an anode electrode in the light-emitting substrate according to the present invention.
Figure 5B:
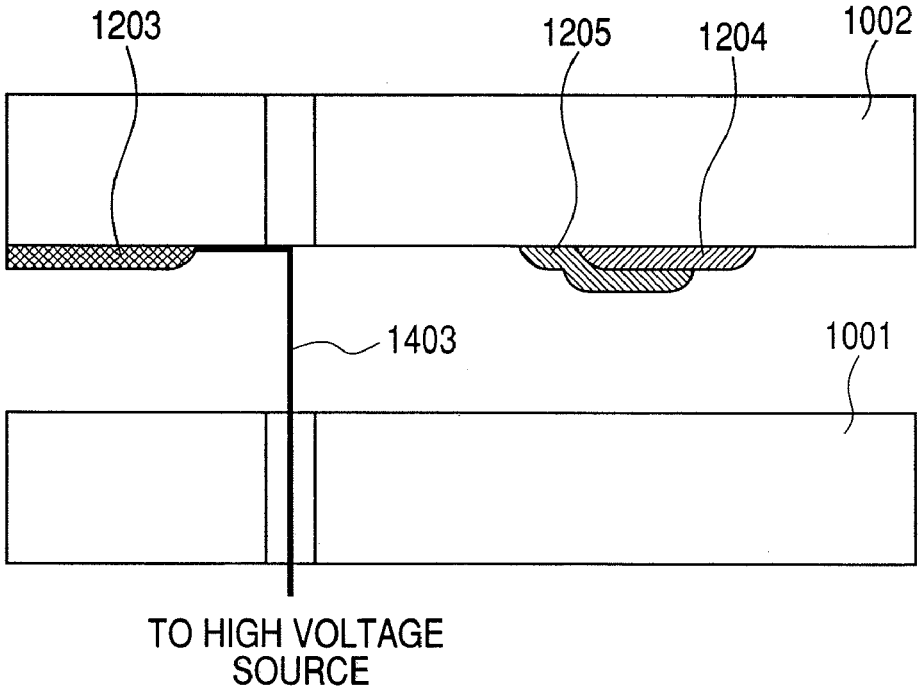

Next, a method of connecting the first electroconductive film 1203 with the high voltage source 1006 for generating the anode voltage will be described with reference to FIGS. 5A and 5B. Here, to make the description easy, the first electroconductive film is indicated by reference numeral 1203. As described above, for example, there are the case where the first electroconductive film is composed of the metal back 1202, the case where the first electroconductive film is composed of the metal back 1202 and the light absorbing member 1203, and the case where the first electroconductive film is composed of the metal back 1202, the light absorbing member 1203 and another member. In any case, FIGS. 5A and 5B each schematically show only the end portion of the first electroconductive film (anode electrode) 1203 which is located on the second electroconductive film 1204 side.

It is preferable that a wiring 1403 led from the first electroconductive film 1203 to the high voltage source 1006 be located in the airtight container 100 so as not to cross the second electroconductive film 1204. This reason is as follows. When a structure in which the wiring 1403 for connecting the high voltage source 1006 with the first electroconductive film (anode electrode) crosses the second electroconductive film 1204 is used because the airtight container 100 has a limited inner space size, it is likely to cause discharge between the wiring 1403 and the second electroconductive film 1204. A method of leading a wiring connected with the first electroconductive film 1203 to an outside of the airtight container 100 through a hole provided in the face plate 1002 (see FIG. 5A), a method of leading the wiring to the outside of the airtight container 100 through a hole provided in the rear plate 1001 (see FIG. 5B), or the like can be employed as a specific method of making an arrangement in which the wiring 1403 led from the first electroconductive film 1203 to the high voltage source 1006 does not cross the second electroconductive film 1204. It is necessary to fill the hole opened in the face plate 1002 or the rear plate 1001 with low-melting glass frit or the like after the wiring 1403 passes therethrough.

In the image display apparatus according to the present invention, an atmospheric pressure withstanding member which is called a spacer can be provided in addition to the structure shown in FIG. 6. Hereinafter, the above-mentioned display apparatus and an image display apparatus in which a planer spacer is located will be specifically described with reference to FIGS. 2A and 2B.

Figure 2A:
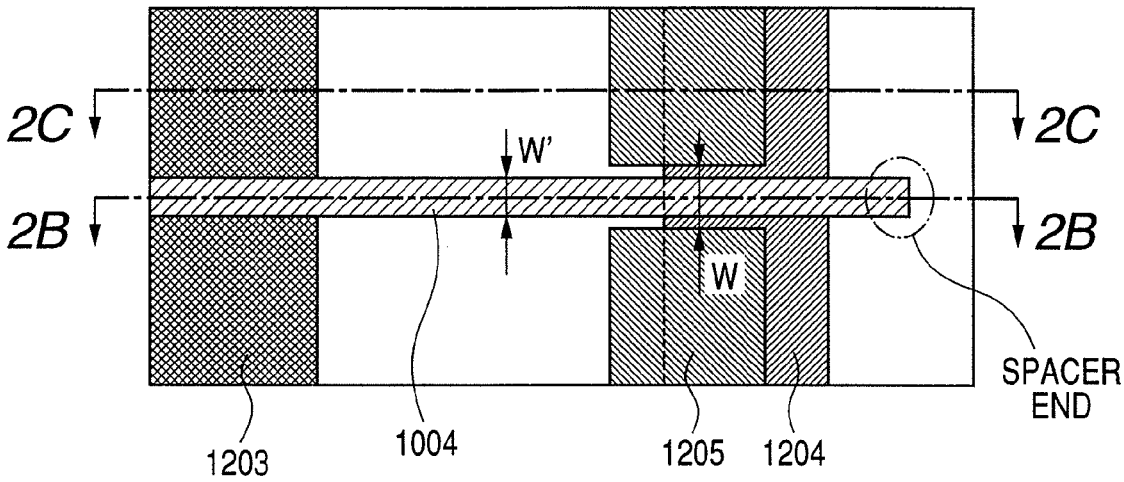
FIGS. 2A, 2B, and 2C are schematic explanatory sectional views each showing an image display apparatus including a dielectric film in the present invention.
Figure 2B:
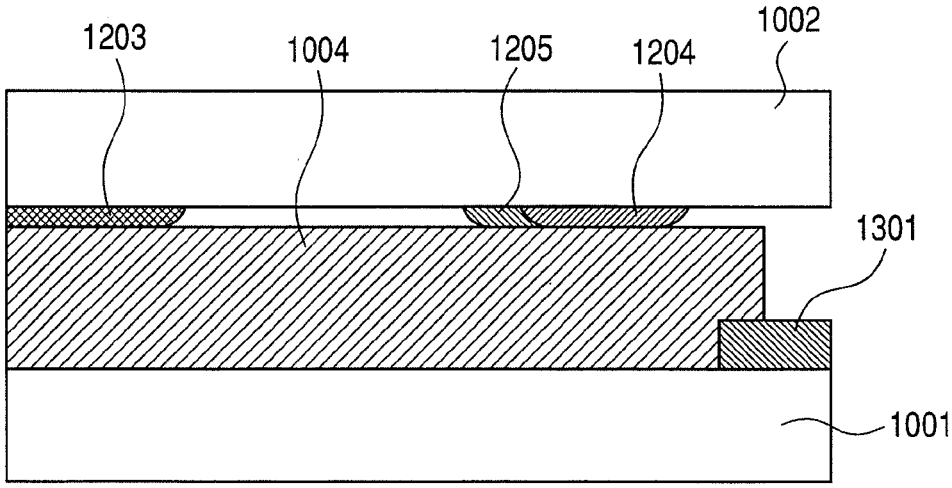
Figure 2C:
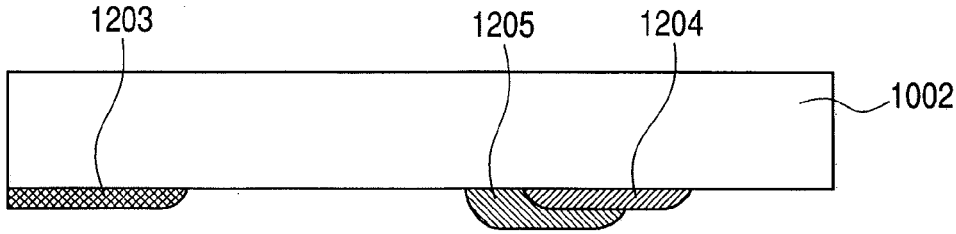

FIG. 2A is a schematic partial plan view showing a structure of a light-emitting substrate (face plate) and a structure of an end of a spacer 1004 in the image display apparatus including the spacer as when the light-emitting substrate is viewed from the rear plate 1001 side. FIG. 2B is a schematic sectional view along a 2B-2B line of FIG. 2A. FIG. 2C is a schematic sectional view along a 2C-2C line of FIG. 2A, in which the rear plate 1001 is omitted. Here, to make the description easy, the first electroconductive film (anode electrode) is indicated by reference numeral 1203. As described above, for example, there are the case where the first electroconductive film is composed of the metal back 1202, the case where the first electroconductive film is composed of the metal back 1202 and the light absorbing member 1203, and the case where the first electroconductive film is composed of the metal back 1202, the light absorbing member 1203, and another member. In any case, FIGS. 2A and 2B each schematically show only the end portion of the first electroconductive film which is located on the second electroconductive film 1204 side.

In FIGS. 2A and 2B, the spacer 1004 is mainly provided to withstand an atmospheric pressure applied in directions in which the rear plate 1001 and the face plate 1002 are opposed to each other when a vacuum is maintained between the rear plate 1001 and the face plate 1002. A spacer made of planer glass or planer ceramic is suitably used as the spacer 1004. Both ends of the spacer in the longitudinal direction (only one of the ends is shown in FIGS. 2A and 2B) are preferably located on the side outside the end of the second electroconductive film 1204 which is opposed to the first electroconductive film 1203 (side distant from the anode electrode).

For example, an adhesive or fixing member (1301) for fixing the spacer to the face plate and/or the rear plate is located in the end of the spacer 1004 in some cases. The adhesive or fixing member may become a discharge element. Because a sharp-edged portion or the like exists in the end of the spacer, the spacer is generally likely to cause discharge. Such structures (end of the spacer and the fixing member) are located in an outer region outside a region caused by orthogonal projection to the second electroconductive film. Here, the outer region is a region in which an electric field is weak. Therefore, it is possible to suppress discharge resulting from the structures (end of the spacer and the fixing member).

Assume that each of the anode electrode 1203 and the second electroconductive film 1204 which are shown in FIGS. 2A to 2C has the same structure as that described earlier with reference to FIG. 10 and the like. It is preferable to provide an opening in the dielectric film 1205 at the position in which the spacer 1004 is located. That is, it is not preferable that the dielectric film 1205 be located in a region between the spacer and the face plate 1002. A width W (μm) of the opening is preferably set in a practical range longer than a width W' of the spacer by 1 μm to 50 μm. The width W' (μm) of the spacer is set in a practical range of 50 μm to 300 μm.

When a potential on the surface of the spacer 1004 which is opposed to the second electroconductive film is largely different from a potential on the surface of the second electroconductive film which is opposed to the spacer, electric field concentration occurs between the spacer 1004 and the second electroconductive film 1204 to cause discharge in some cases. Therefore, it is preferable that the potential on the surface of the spacer 1004 which is opposed to the second electroconductive film 1204 be made substantially equal to the potential on the surface of the second electroconductive film 1204 which is opposed to the spacer 1004. When the spacer 1004 is in contact with the second electroconductive film 1204, the potential of the second electroconductive film 1204 can be supplied to the spacer 1004, so that the electric field concentration and the discharge resulting therefrom can be prevented.

When the surface of the second electroconductive film 1204 is completely covered with the dielectric film 1205, the spacer 1004 cannot be in electrical contact with the second electroconductive film 1204, so it is hard to supply the potential to the spacer. When a structure in which the dielectric film 1205 is not located in a region between the spacer 1004 and the second electroconductive film 1204 is used, the spacer 1004 and the second electroconductive film 1204 can be made in contact with each other. As a result, the potential on the surface of the spacer 1004 which is opposed to the second electroconductive film 1204 is made substantially equal to the potential on the surface of the second electroconductive film 1204 which is opposed to the spacer 1004 (see FIGS. 2A and 2B). Because the spacer 1004 is located in the region in which the dielectric film 1205 is not provided (see FIG. 2A), the spacer 1004 can serve the same function as that of the dielectric film 1205 as described above (function of suppressing the electron emission from the second electroconductive film). Therefore, it is possible to suppress a reduction in withstand voltage of the region in which the dielectric film 1205 is not provided. The structure in which the spacer 1004 and the second electroconductive film 1204 are directly connected with each other is described here. In another structure, substantially the same potential as that of the second electroconductive film 1204 may be applied to the surface of the spacer 1004 which is opposed to the second electroconductive film 1204 without direct contact between the spacer 1004 and the second electroconductive film 1204.

In the present invention, when an electron capture structure 1206 which is a structure for capturing electrons is provided in addition to the dielectric film 1205 which is a feature of the present invention regardless of the presence or absence of the spacer 1004, a withstand voltage (surface withstand voltage) between the first electroconductive film and the second electroconductive film can be additionally improved.

The electron capture structure in the present invention will be described with reference to FIGS. 3A, 3B, and 4. The function of the electron capture structure is to prevent the secondary electron emission avalanche on the surface of the substrate between the first electroconductive film 1203 and the second electroconductive film 1204 (dielectric film 1205). When the secondary electron emission avalanche is to be prevented, it is effective that a secondary electron emission coefficient on the surface of the substrate is lowered to substantially 1 or less. More specifically, when the electron trajectory can be shortened to reduce energy obtained by electrons, the secondary electron emission coefficient can be lowered to a value smaller than 1, so it is possible to prevent an avalanche increase in the number of electrons. A structure using a dielectric can be employed as the structure for shortening the electron trajectory. More specifically, it is possible to use a dielectric having a surface nearly perpendicular to a direction of an average electric field gradient between the first electroconductive film (anode electrode) 1203 and the second electroconductive film 1204. When such a structure is provided, electrons can be charged again to the dielectric before sufficient acceleration. As a result, an avalanche increase in the number of electrons can be prevented. When the structure having the above-mentioned function (electron capture structure) is provided on the surface of the face plate between the first electroconductive film 1203 and the second electroconductive film 1204 (dielectric film 1205), it is possible to realize the improvement of the surface withstand voltage between the first electroconductive film 1203 and the second electroconductive film 1204. Therefore, a convex structure using a dielectric (electron capture structure) 1206 is preferably provided between the first electroconductive film 1203 and the second electroconductive film 1204 (see FIG. 3A).

The electron capture structure 1206 is the convex structure and each of side walls thereof has a surface nearly perpendicular to a plane joining the first electroconductive film 1203 to the second electroconductive film 1204 (surface of the face plate 1002). When the side walls exist, the possibility in which secondary electrons generated by irradiation of the side walls with electrons are immediately charged again to the side walls increases. Therefore, the electron trajectory can be shortened, so the secondary electron emission coefficient can be lowered to substantially 1 or less. Thus, it is possible to suppress the secondary electron emission avalanche between the first electroconductive film 1203 and the second electroconductive film 1204 (dielectric film 1205).

Figure 3A:
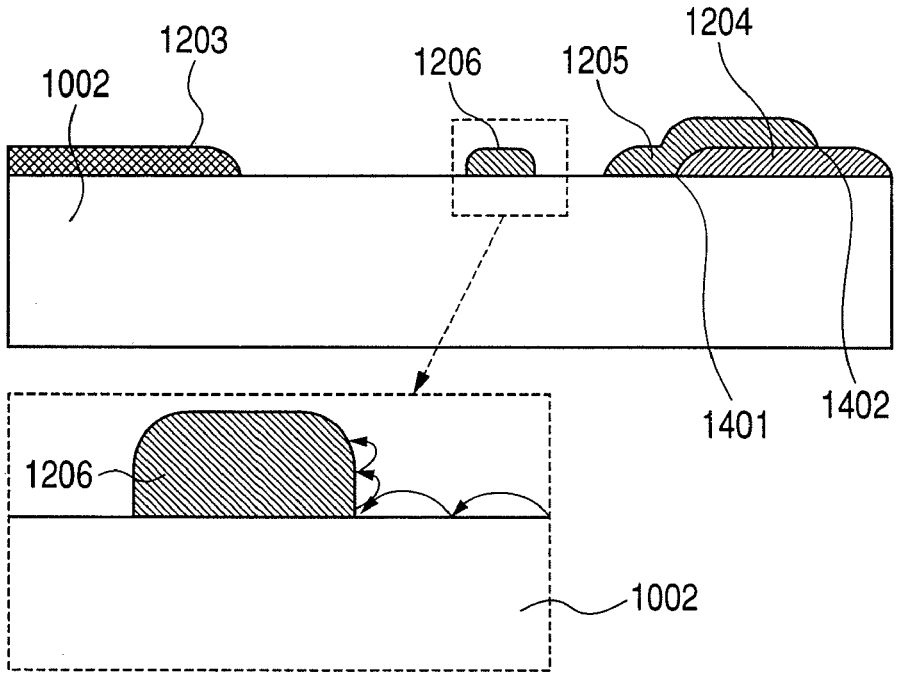
FIGS. 3A and 3B are schematic explanatory sectional views each showing a light-emitting substrate including an electron capture structure in the present invention.
Figure 3B:
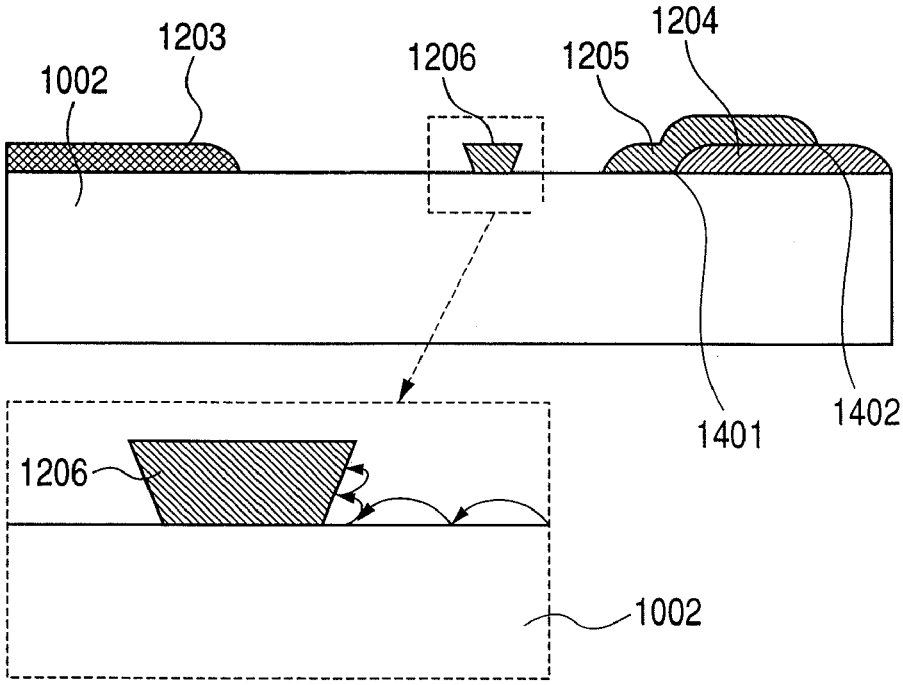

As shown in FIG. 3B, the electron capture structure 1206 is used in which a cross sectional area at a position close to the face plate 1002 is made smaller than a cross sectional area at a position distant from the face plate 1002 when the electron capture structure 1206 is cut along a plane parallel to the substrate. Therefore, secondary electrons generated in the side walls of the electron capture structure 1206 hardly climb over the electron capture structure 1206. That is, the secondary electrons generated near the electron capture structure 1206 are hardly escaped from a recess of the electron capture structure 1206. Thus, the electron capture can be suitably made. As a result, as compared with the structure shown in FIG. 3A, an electron capture effect obtained by the electron capture structure 1206 (effect for suppressing the generation of the secondary electrons) can be increased and the surface withstand voltage can be additionally improved.

As is also apparent from the above descriptions, it is necessary that a height of the electron capture structure 1206 in the present invention be set to be equal to or larger than a height in which electrons hardly climb over. The height is preferably set in a practical range of 1 μm to 100 μm.

As shown in FIGS. 3A and 3B, it is preferable to use a structure in which an angle formed between the side surface (side wall) of the electron capture structure 1206 which is located on the second electroconductive film 1204 side and the surface of the face plate 1002 becomes vertical or acute (overhung electron capture structure 1206).

A method of obtaining the above-mentioned structure includes a method involving producing paste containing low-melting glass using a screen printing method or a photolithography method.

In particular, when the photolithography method is used, the above-mentioned overhung structure can be formed with high precision. Another producing method is a method involving the electron capture structure 1206 in advance using a dielectric material such as glass and fixing onto the face plate 1002 by an adhesive or the like.

Even when the electron capture structure 1206 is located in any position on the surface of the face plate 1002 between the anode electrode 1203 and the second electroconductive film 1204, a predetermined effect is obtained. Here, when it is assumed that the field emission electrons are emitted from the second electroconductive film 1204, it is preferable to locate the electron capture structure 1206 in a position closest to the second electroconductive film 1204. When the second electroconductive film 1204 is formed so as to surround the first electroconductive film 1203, the electron capture structure 1206 is preferably formed so as to surround the first electroconductive film 1203. That is, it is preferable to locate the electron capture structure 1206 along the end of the second electroconductive film 1204 which is located on the first electroconductive film side.

Figure 4:
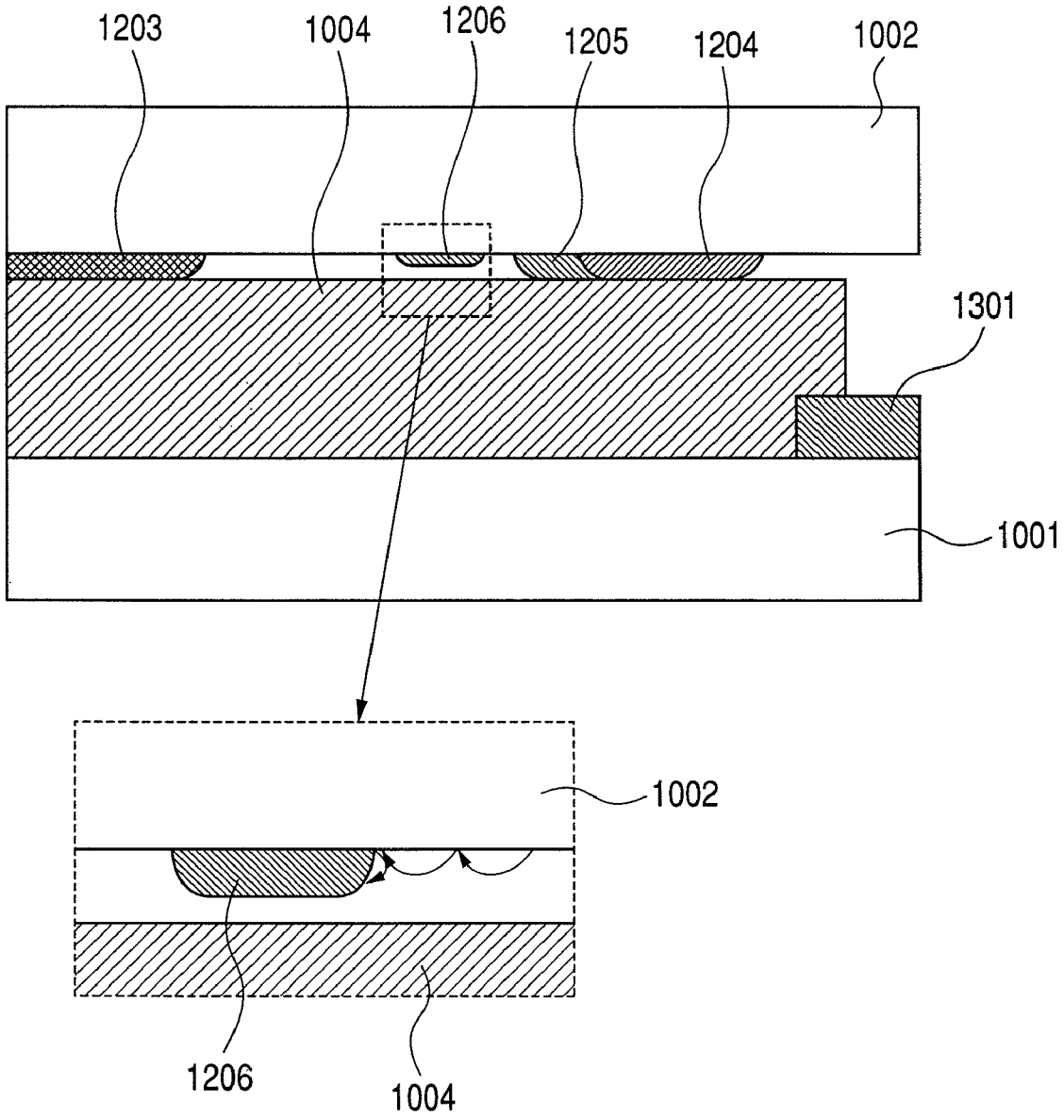
FIG. 4 is a schematic explanatory sectional view showing an image display apparatus including an electron capture structure in the present invention.

When the spacer 1004 is provided in the image display apparatus as described above, it is preferable to locate the electron capture structure 1206 between the spacer 1004 and the face plate 1002 as shown in FIG. 4. According to such a structure, as described with reference to FIGS. 2A and 2B, even when the dielectric film 1205 is not located between the spacer and the face plate 1002, the secondary electron emission avalanche caused in the vicinity of the spacer 1004 is suppressed, so that the surface withstand voltage between the first electroconductive film 1203 and the second electroconductive film 1204 can be improved.

When the electron capture structure 1206 is thicker (higher) than the first electroconductive film 1203 and the second electroconductive film 1204, the spacer 1004 is hardly in contact with the first electroconductive film 1203 and the second electroconductive film 1204. Therefore, it is preferable that a height of the electron capture structure 1206 be substantially equal to or lower than heights of the first electroconductive film 1203 and the second electroconductive film 1204.

An information display and reproduction apparatus can be composed of the airtight container (image display apparatus) 100 according to the present invention as described with reference to FIG. 6.

More specifically, a broadcast signal on a television broadcast is received by a receiving apparatus. The received signal is selected by a tuner. At least one of video information, character information, and voice information which are included in the selected signal is outputted to the airtight container (image display apparatus) 100 and displayed and/or reproduced. Therefore, an information display and reproduction apparatus such as a television can be constructed. Of course, when the broadcast signal is encoded, the information display and reproduction apparatus according to the present invention can include a decoder. The voice signal is outputted to separate voice reproducing means such as a speaker and reproduced in synchronization with the video information and the character information which are displayed on the airtight container (image display apparatus) 100.

Figure 18:
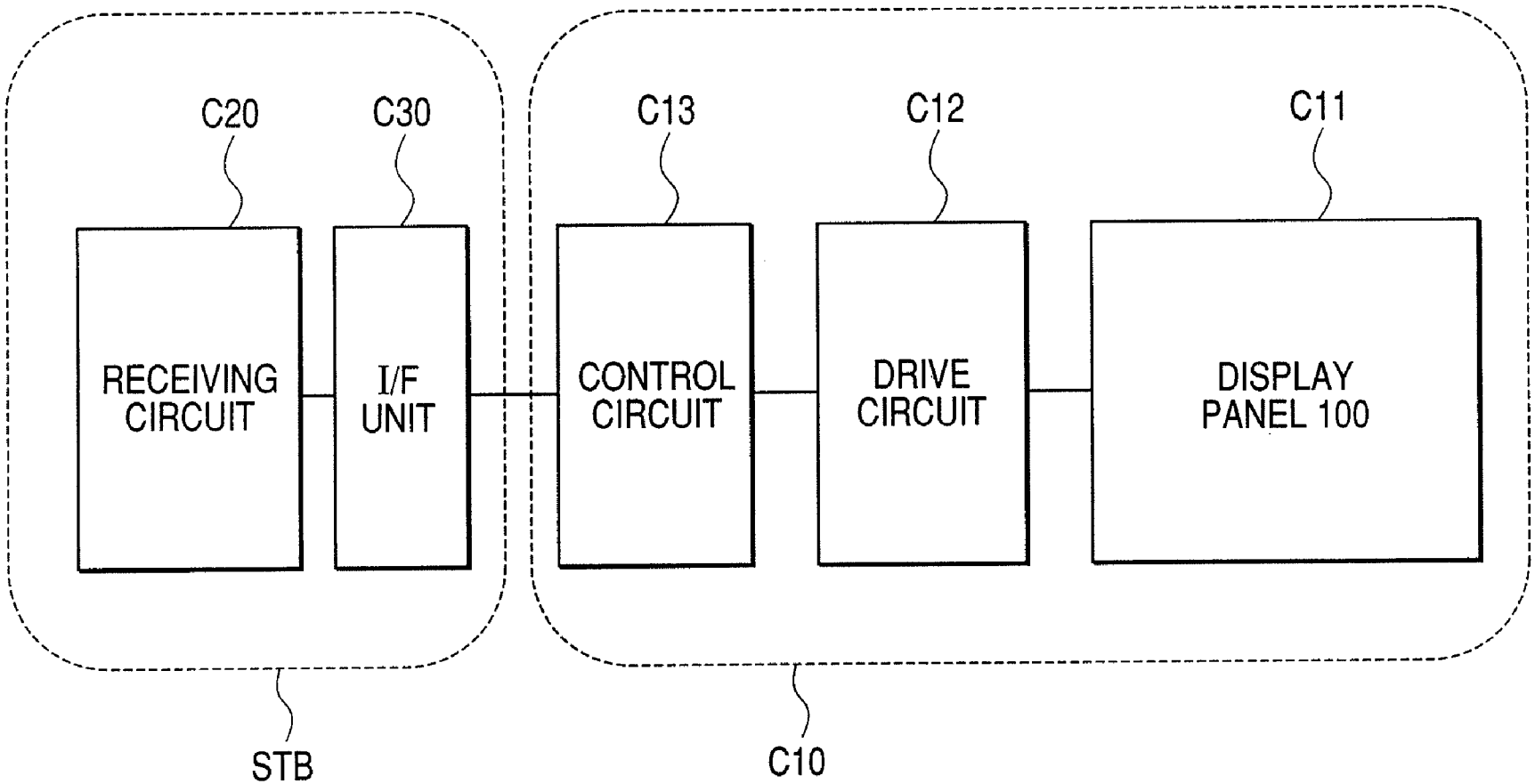
FIG. 18 is a block diagram showing an example of an information display and reproduction apparatus using the image display apparatus according to the present invention.

For example, a method of outputting the video information or the character information to the airtight container (image display apparatus) 100 to display and/or reproduce it can be performed as follows. FIG. 18 is a block diagram showing a television apparatus according to the present invention. A receiving circuit C20 is composed of a tuner, a decoder, and the like. The receiving circuit receives a television signal on satellite broadcasting or terrestrial broadcasting, a signal on data broadcasting through a network, or the like and outputs decoded video data to an I/F unit (interface unit) C30. The I/F unit C30 converts the video data into a display format of an image display apparatus and outputs image data to a display panel C11 (100). The image display apparatus includes the display panel C11, a drive circuit C12, and a control circuit C13. The control circuit C13 performs image processing such as correction processing suitable for the display panel C11 on the inputted image data and outputs the processed image data and various control signals to the drive circuit C12. The drive circuit C12 outputs a drive signal to each of the wirings (see Dox1 to Doxm and Doy1 to Doyn in FIG. 14) of the display panel C11 (100) based on the inputted image data, thereby displaying a television image. The receiving circuit C20 and the I/F unit C30 may be stored in a case which serves as a set-top box (STB) and is separated from the image display apparatus. The receiving circuit C20 and the I/F unit C30 may be stored in the same case as that storing the image display apparatus.

It is possible to use a structure in which the interface can be connected with an image recording apparatus and an image outputting apparatus, for example, a printer, a digital video camera, a digital camera, a hard disk drive (HDD), and a digital video disk (DVD). Therefore, an image recorded in the image recording apparatus can be displayed on the display panel C11. In addition, it is possible to produce an information display and reproduction apparatus (or a television) capable of processing the image displayed on the display panel C11 if necessary and outputting the image to the image outputting apparatus.

The image display apparatus described here is an example of an image display apparatus to which the present invention can be applied. Therefore, various modifications can be made based on technical ideas of the present invention. The image display apparatus according to the present invention can be also used as a display apparatus for a television conference system, a computer, or the like.

The image display apparatus according to the present invention can be also used as, for example, an image forming apparatus such as an optical printer using a photosensitive drum or the like in addition to a display apparatus for television broadcasting and the display apparatus for a television conference system, a computer, or the like.

Hereinafter, specific embodiments of the present invention will be described in more detail.

Embodiment 1

This embodiment is an example of the light-emitting substrate shown in each of FIGS. 1A to 1C and 10. FIG. 10 is a schematic plan view showing the face plate (light-emitting substrate) according to this embodiment when the surface on which the phosphor and the like are formed is viewed.

First, soda lime glass is used for a transparent substrate which becomes the face plate 1002. The soda lime glass having a thickness of 2.8 mm is cleaned and the electroconductive black matrix 1203 is formed thereon in a grid shape by a photolithography method. The openings (phosphor regions) are arranged in the grid shape. In this embodiment, the black matrix 1203 composes a portion of the anode electrode.

Photosensitive carbon black is used as a material of the black matrix 1203 and formed at a thickness of 5 micrometers by a photolithography method. A pitch of a repeated pattern is set to 200 micrometers in a lateral direction (X-direction) and 600 micrometers in a longitudinal direction (Y-direction). A line width of the black matrix is set to 50 micrometers in the longitudinal direction (Y-direction) and 300 micrometers in the lateral direction (X-direction). The second electroconductive film 1204 is formed simultaneously with the formation of the black matrix 1203. The outer periphery of the black matrix 1203 is set in a range of 2 mm from the position in which the opening of the black matrix is provided to the outside. The second electroconductive film 1204 having a width of 2 mm is formed so as to surround the black matrix 1203 at a distance of 2 mm from the outer periphery of the black matrix 1203.

Next, the openings (phosphor regions 131, 132, and 133) of the black matrix are filled with fluorescent layers for respective colors based on the arrangement as shown in FIG. 10. Fluorescent materials of three colors of R, G, and B are separately produced in the openings of the black matrix by a screen printing method such that each of thicknesses thereof becomes 10 micrometers.

Each of the fluorescent materials is a fluorescent material of P22 used in the field of CRT. The fluorescent materials includes a material for red (P22-RE3; $Y_2O_2S:Eu^{3+}$), a material for blue (P22-B2; ZnS:Ag, Al), and a material for green (P22-GN4; ZnS:Cu, Al).

Next, the dielectric film 1205 is formed. Dielectric paste containing low-melting glass frit (including lead oxide) as a main ingredient is used for the dielectric film 1205 and formed at a thickness of 10 micrometers by a screen printing method.

The dielectric film 1205 is extended from the end of the second electroconductive film 1204 which is located on the black matrix side to the black matrix 1203 side by 500 micrometers. The dielectric film is located so as to cover the second electroconductive film 1204 in a range of 500 micrometers from the end of the second electroconductive film 1204 which is located on the black matrix side in a direction distant from the black matrix 1203. The dielectric film 1205 is formed so as to cover the entire end of the second electroconductive film 1204.

After the dielectric paste is applied so as to obtain the above-mentioned arrangement, baking is performed at 450° C. in an atmosphere. Volume resistivity of a test piece manufactured by baking the used dielectric paste is measured. As a result, the volume resistivity is about $10^{12}$ Ωm.

Next, a resin film is formed on the black matrix and the phosphor by a filming process which is known as a cathode ray tube manufacturing technique. After that, an aluminum evaporation film is deposited on the resin film. Finally, the resin film is removed by thermal decomposition to produce the metal back 1202 having a thickness of 100 nm on the black matrix 1203 and the phosphor. The outer periphery of the metal back 1202 is located inside the outer periphery of the black matrix 1203. In this embodiment, the black matrix 1203 and the metal back 1202 compose the anode electrode.

Figure 11:
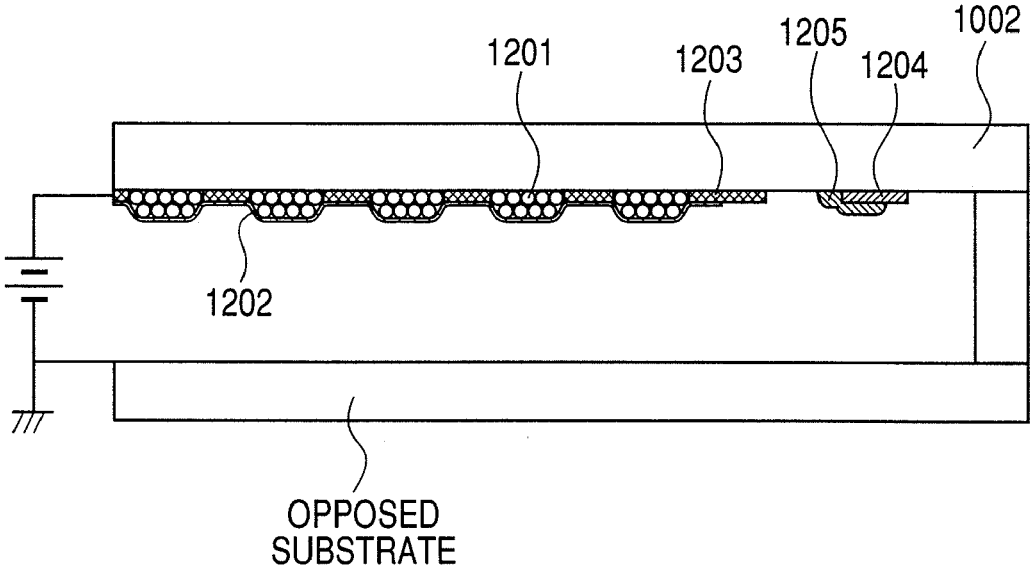
FIG. 11 is a schematic sectional view showing a method of evaluating a withstand voltage of the light-emitting substrate according to the present invention.

Next, a withstand voltage between the anode electrodes (1202 and 1203) and the second electroconductive film 1204 on the face plate 1002 (light-emitting substrate) manufactured thus is evaluated. As shown in FIG. 11, according to the evaluating method, first, the manufactured face plate 1002 and an opposed substrate which is a metallic plate processed by electrolytic polishing are opposed to each other at an interval and are set in a vacuum chamber. The vacuum chamber is evacuated up to $5\times10^{-4}$ [Pa]. Then, a voltage from the high voltage source is supplied to the anode electrode 1203 and a GND potential is supplied to the second electroconductive film 1204 and the opposed substrate. With such a state, a discharge phenomenon is observed. An observation method includes current measurement during discharge and light emission observation.

The face plate in this embodiment is evaluated with respect to a withstand voltage. As a result, when the anode voltage is 20 kV, discharge is not caused for a predetermined time or longer and a stable state is obtained. After that, when the voltage is gradually increased, discharge is caused at 31 kV.

Therefore, according to the light-emitting substrate in this embodiment, it is possible to apply a high voltage and obtain high reliability.

Embodiment 2

This embodiment shows an example using the electron capture structure 1206 shown in FIG. 3A. The face plate except for the electron capture structure 1206 is manufactured by the same method as that in Embodiment 1.

The electron capture structure 1206 is formed as in the formation of the dielectric film 1205 in Embodiment 1. Dielectric paste containing low-melting glass frit (including lead oxide) as a main ingredient is used. A convex portion is formed from a dielectric having a width of 100 micrometers and a thickness of 10 micrometers.

The face plate manufactured thus is evaluated with respect to a withstand voltage by the same method as that in Embodiment 1. As a result, when the anode voltage is 20 kV, discharge is not caused for a predetermined time or longer and a stable state is obtained. After that, when the voltage is gradually increased, discharge is caused at 35 kV. Therefore, according to the light-emitting substrate in this embodiment, it is possible to apply a high voltage and obtain high reliability.

Embodiment 3

This embodiment shows an example in which the end of the anode electrode 1203 is covered with the dielectric film 1205 as shown in FIGS. 8A and 8B. The dielectric film is formed by the same method as that in Embodiment 1 except that the dielectric film 1205 is provided on the anode electrode 1203 side.

The dielectric film 1205 stacked on the end of the anode electrode 1203 which is located on the second electroconductive film 1204 side is formed simultaneously with the formation of the dielectric film 1205 in Embodiment 1. Dielectric paste containing low-melting glass frit (including lead oxide) as a main ingredient is used. The dielectric film 1205 is formed by a screen printing method. The dielectric film 1205 formed on the anode electrode 1203 side is extended from the end of the anode electrode 1203 which is located on the second electroconductive film 1204 side to the second electroconductive film side by 500 micrometers. The dielectric film is stacked in a range of 500 micrometers from the end of the anode electrode 1203 which is located on the second electroconductive film 1204 side in a direction distant from the second electroconductive film. The thickness is set to 10 micrometers.

The face plate manufactured thus is evaluated with respect to a withstand voltage by the same method as that in Embodiment 1. As a result, when the anode voltage is 20 kV, discharge is not caused for a predetermined time or longer and a stable state is obtained. After that, when the voltage is gradually increased, discharge is caused at 32 kV. Therefore, according to the light-emitting substrate in this embodiment, it is possible to apply a high voltage and obtain high reliability.

Embodiment 4

In this embodiment, the airtight container 100 shown in FIG. 6 is produced using the light-emitting substrate shown in FIG. 1B and an image display apparatus is manufactured using the airtight container.

The face plate 1002 has the same structure as that in Embodiment 1 and is produced so as to obtain the same arrangement as that shown in FIG. 10. In this embodiment, the dielectric film 1205 is extended from the end of the second electroconductive film 1204 which is located on the black matrix 1203 side to the black matrix 1203 side by 100 micrometers. The dielectric film is located so as to cover the second electroconductive film 1204 in a range of 65 micrometers from the end of the second electroconductive film 1204 which is located on the black matrix side in a direction distant from the black matrix 1203. The dielectric film 1205 is formed so as to cover the entire end of the second electroconductive film 1204 which is located on the black matrix 1203 side.

The face plate 1002 prepared thus is opposed to the rear plate 1001 on which the large number of surface conduction electron-emitting devices 1101 are arranged. The side wall 1003 is interposed between the face plate 1002 and the rear plate 1001. An interval between the face plate 1002 and the rear plate 1001 is set to 2 mm. A size of a vacuum container surrounded by the side wall 1003 is set to 70 mm×50 mm. The interval between the face plate 1002 and the rear plate 1001 is about 2 mm even when a member for regulating the interval is not provided. A method of producing the rear plate 1001 including the surface conduction electron-emitting devices 1101 is omitted here.

The side wall 1003 and the face plate 1002 are bonded to each other using a bonding material and the side wall 1003 and the rear plate 1001 are bonded to each other using the bonding material, thereby producing the airtight container 100 shown in FIG. 6. Bonding (sealing) among the side wall 1003, the face plate 1002, and the rear plate 1001 is performed in a vacuum atmosphere. Indium is used as the bonding material.

The airtight container 100 produced thus is connected with a driver circuit to construct an image display apparatus and withstand voltage evaluation is performed. In the withstand voltage evaluation, column directional wirings 1102 and row directional wirings 1103 on the rear plate 1001 are regulated to a GND potential and the second electroconductive film 1204 on the face plate 1002 is also regulated to the GND potential. With such a state, the anode electrode 1203 is connected with the high voltage source and the electron-emitting device is driven at 15 kV. The result confirms that discharge is not caused for a predetermined time or longer.

After that, drive signals are applied to the surface conduction electron-emitting devices through the column directional wirings 1102 and the row directional wirings 1103 and an image is displayed at the anode voltage of 12 kV. As a result, it is possible to stably display a preferable image having a high intensity and large contrast for a long period.

Here, when the column directional wirings 1102 and the row directional wirings 1103 are connected with the terminal for the GND potential again and the anode voltage to be applied to the anode is gradually increased, discharge is caused at 30 kV.

As described above, according to this embodiment, it is possible to obtain the image display apparatus to which a high voltage can be stably applied.

Only a length of the dielectric film 1205 covering the second electroconductive film 1204 (L described above) is set to be longer than that in this embodiment. Then, as in this embodiment, the anode voltage is gradually increased and a voltage at the time of start of discharge is measured. As a result, discharge is observed at 30 kV in any case regardless of the length of the dielectric film 1205 covering the second electroconductive film 1204.

Embodiment 5

In this embodiments the dielectric film 1205 is extended from the end of the second electroconductive film 1204 which is located on the black matrix side to the black matrix 1203 side by 100 micrometers. The dielectric film is located so as to cover the second electroconductive film 1204 in a range of 30 micrometers from the end of the second electroconductive film 1204 which is located on the black matrix side in a direction distant from the black matrix 1203. The dielectric film 1205 is formed so as to cover the entire end of the second electroconductive film 1204 which is located on the black matrix side. An image display apparatus is manufactured as in Embodiment 4 except for the size of the dielectric film 1205.

As in Embodiment 4, the column directional wirings 1102 and the row directional wirings 1103 of the manufactured image display apparatus are connected with a terminal for the GND potential and the withstand voltage evaluation is performed. The result confirms that discharge is not caused at 15 kV for a predetermined time or longer. When an image is displayed at the anode voltage of 12 kV, it is possible to stably display a preferable image having a high intensity and large contrast for a long period.

Here, when the column directional wirings 1102 and the row directional wirings 1103 are connected with the terminal for the GND potential again and the anode voltage is gradually increased, discharge is caused at 25 kV.

As described above, according to this embodiment, it is possible to obtain the image display apparatus to which a high voltage can be stably applied.

Embodiment 6

In this embodiment, the airtight container 100 in which the planar spacer 1004 is located between the face plate 1002 and the rear plate 1001 is produced and an image display apparatus is manufactured using the airtight container.

The face plate 1002 has the same structure as that in Embodiment 1 and is produced so as to obtain the same arrangement as that shown in FIG. 10. In this embodiment, the spacer 1004 is used. Therefore, as shown in FIGS. 2A to 2C, the dielectric film 1205 is not provided between the spacer 1004 and the second electroconductive film 1204 such that the second electroconductive film 1204 and the spacer 1004 can be in contact with each other. More specifically, a slit of 400 micrometers is provided in the dielectric film 1205 such that the spacer 1004 and the second electroconductive film 1204 can be in contact with each other. Volume resistivity of a test piece manufactured by baking the used dielectric paste is measured. As a result, the volume resistivity is about $10^8$ Ωm.

The face plate 1002 prepared thus is opposed to the rear plate 1001 on which the large number of surface conduction electron-emitting devices 1101 are arranged. The side wall 1003 is interposed between the face plate 1002 and the rear plate 1001. The spacer 1004 is located between the face plate 1002 and the rear plate 1001 such that an interval therebetween is set to 2 mm. A thickness of the spacer is set to 200 micrometers. The spacer 1004 is fixed to the rear plate 1001 by the bonding material 1301 (see FIG. 2B). The spacer 1004 is located in advance such that the position thereof corresponds to the slit of the dielectric film 1205 of the face plate 1002. A method of producing the rear plate 1001 including the surface conduction electron-emitting devices 1101 and a method of forming the spacer are omitted here. A method of producing the airtight container 100 is identical to that in Embodiment 4.

The airtight container 100 produced thus is connected with a driver circuit to construct an image display apparatus and withstand voltage evaluation is performed. In the withstand voltage evaluation, the column directional wirings 1102 and the row directional wirings 1103 on the rear plate 1001 are regulated to a GND potential and the second electroconductive film 1204 on the face plate 1002 is also regulated to the GND potential. With such a state, the anode electrode 1203 is connected with the high voltage source and the electron-emitting device is driven at 15 kV. The result confirms that discharge is not caused for a predetermined time or longer.

After that, drive signals are applied to the surface conduction electron-emitting devices through the column directional wirings 1102 and the row directional wirings 1103 and an image is displayed at the anode voltage of 12 kV. As a result, it is possible to stably display a preferable image having a high intensity and large contrast for a long period.

Here, when the column directional wirings 1102 and the row directional wirings 1103 are connected with the terminal for the GND potential again and the anode voltage is gradually increased, discharge is caused at 25 kV.

As described above, according to this embodiment, it is possible to obtain the image display apparatus to which a high voltage can be stably applied.

Embodiment 7

This embodiment shows an example of an image display apparatus manufactured using the face plate 1002 in which the second electroconductive film 1204 is composed of two kinds of electroconductive films (1207 and 1208) as shown in each of FIG. 17A to 17C. The formation is performed by the same method as that in Embodiment 6 except that the second electroconductive film 1204 is composed of two kinds of electroconductive films.

According to a method of forming the second electroconductive film 1204, first, the electroconductive film 1207 made of aluminum is formed at a thickness of 100 nm by mask film formation. At this time, with respect to unevenness on a flat surface, it is determined that h/r at any position becomes 10 or less when a size of the convex shape as shown in FIG. 16C is defined (curvature radius r and convex length h). Then, the electroconductive film 1208 made of silver paste is formed at a thickness of 10 μm by a screen printing method. When the formed electroconductive film 1208 is observed, unevenness is present in a planar shape as shown in each of FIGS. 17A to 17C. A maximum value of h/r with respect to unevenness is about 200.

Next, the dielectric film 1205 is formed with a state in which a slit of 400 micrometers is provided in a region on which the spacer 1004 is located. Here, planar unevenness on a region in which the dielectric film 1205 is not provided and the second electroconductive film is exposed is formed to be substantially flat by the electroconductive film 1207. Therefore, it, can be expected that the electric field concentration be hardly caused in the region.

The same image display apparatus as that in Embodiment 6 is manufactured using the face plate 1002 produced thus. Then, as in Embodiment 4, the column directional wirings 1102 and the row directional wirings 1103 are connected with a terminal for the GND potential and the withstand voltage evaluation is performed. The result confirms that discharge is not caused at 15 kV for a predetermined time or longer. When an image is displayed at the anode voltage of 12 kV, it is possible to stably display a preferable image having a high intensity and large contrast for a long period.

Here, when the column directional wirings 1102 and the row directional wirings 1103 are connected with the terminal for the GND potential again and the anode voltage is gradually increased, discharge is caused at 25 kV.

As described above, according to this embodiment, it is possible to obtain the image display apparatus to which a high voltage can be stably applied.

Reference Example

A light-emitting substrate produced by the same method as that in Embodiment 1 except that the dielectric film 1205 is not provided is prepared (see FIG. 1A). The light-emitting substrate produced thus is evaluated for withstand voltage by the same method as that in Embodiment 1. As a result, discharge is caused at 12 kV.

This application claims priority from Japanese Patent Application No. 2004-239528 filed on Aug. 19, 2004, which is hereby incorporated by reference herein.

What is claimed is:

1. An image display apparatus, comprising:

an airtight container having an inner space, a light-emitting member, for emitting light by irradiation with an electron beam, located in the inner space, an electrode to be maintained with anode potential located in the inner space, an electron-emitting device, for emitting the electron beam, located in the inner space, and an electroconductive film which is distant from an outer periphery of the electrode and is arranged to surround the outer periphery of the electrode;

wherein the electroconductive film has an end portion opposed to the outer periphery of the electrode, and at least a part of an edge of the end portion is covered with a dielectric film, and wherein, when an interval between the light-emitting member and the electron-emitting device is given by H [μm], the dielectric film covers the electroconductive film over a length given by L [μm] from the edge of the electroconductive film in a direction distant from the first electrode, where $L>0.025\times H+15$.

2. The image display apparatus of claim 1, wherein the dielectric film comprises any one of low-melting glass, epoxy, and polyimide.

3. The image display apparatus according to claim 1, wherein the dielectric film has a volume resistivity of $10^8$ Ωm or more and a film thickness of 1 μm or more.

4. The image display apparatus according to claim 1, wherein the electroconductive film has a closed ring structure.

5. The image display apparatus according to claim 1, further comprising:

a light-emitting substrate comprising the electron-emitting member, a light absorbing layer which is located on the light-emitting substrate and has a plurality of openings, wherein the light-emitting member is located corresponding to the plurality of openings, and the light-emitting member and the light absorbing layer are covered with the electrode.

6. The image display apparatus according to claim 5, further comprising a rear plate on which the electron-emitting device is located, wherein a potential to be applied to the electroconductive film is lower than a potential to be applied to the electrode.

7. The image display apparatus according to claim 6, further comprising a spacer located across the electrode and the electroconductive film.

8. The image display apparatus according to claim 7, wherein the dielectric film is located outside a region between the spacer and the electroconductive film.

9. The image display apparatus according to claim 6, wherein a difference between the potential applied to the electrode and a potential applied to the electron-emitting device is 5 kV to 30 kV and a difference between the potential applied to the electroconductive film and the potential applied to the electron-emitting device is equal to or smaller than 1 kV.

* * * * *